US007328669B2

(12) United States Patent
Adams

(10) Patent No.: US 7,328,669 B2
(45) Date of Patent: Feb. 12, 2008

(54) BUOYANCY-BASED, UNDERWATER PROPULSION SYSTEM AND METHOD

(76) Inventor: Phillip M. Adams, 313 Pleasant Summit Dr., Henderson, NV (US) 89012

( * ) Notice: Subject to any disclaimer, the term of this patent is extended or adjusted under 35 U.S.C. 154(b) by 0 days.

(21) Appl. No.: 10/967,816

(22) Filed: Oct. 18, 2004

(65) Prior Publication Data

US 2006/0081168 A1 Apr. 20, 2006

(51) Int. Cl.
*B63C 11/02* (2006.01)

(52) U.S. Cl. ..... 114/315; 114/274; 405/186

(58) Field of Classification Search ..... 114/315, 114/274; 405/185, 186, 187
See application file for complete search history.

(56) References Cited

U.S. PATENT DOCUMENTS

| | | | | |
|---|---|---|---|---|
| 43,449 | A | 7/1864 | Andrews | |
| 3,204,596 | A * | 9/1965 | Fallon | 114/315 |
| 3,898,705 | A * | 8/1975 | Schuler | 405/186 |
| 3,947,906 | A * | 4/1976 | McLane | 114/332 |
| 3,952,349 | A * | 4/1976 | Erath et al. | 114/331 |
| 3,957,007 | A | 5/1976 | Thomas | |
| 4,054,132 | A * | 10/1977 | Deeds | 128/202.14 |
| 4,114,389 | A * | 9/1978 | Bohmrich et al. | 405/186 |
| 4,577,583 | A | 3/1986 | Green, II | |
| 4,850,551 | A | 7/1989 | Krawetz et al. | |
| 5,482,405 | A * | 1/1996 | Tolksdorf et al. | 405/186 |
| 5,514,023 | A | 5/1996 | Warner | |
| 5,997,216 | A | 12/1999 | Kawashima | |
| 6,131,531 | A | 10/2000 | McCanna et al. | |
| 6,328,622 | B1 | 12/2001 | Geery | |
| 6,607,411 | B1 | 8/2003 | McCarthy | |
| 6,647,912 | B1 | 11/2003 | Rogers | |
| 6,709,306 | B2 | 3/2004 | Brown | |

OTHER PUBLICATIONS

Leonard, *Underwater Glider Dynamics and Control*, date unknown, pp. 1-7.
Graver et al., *Underwater Glider Dynamics and Control*, 12th International Symposium on Unmanned Untethered Submersible Technology, 2001, pp. 1-14.
Eng, *Dive Power-Researchers Create Underwater "Glider" Robots*, abcnews.com : Water-Powered Robot Explorers, Oct. 11, 2002, pp. 1-3.
Graver et al., *Underwater Glider Model Parameter Identification*, Proc.13th International Symposium on Unmanned Untethered Submersible Technology (UUST), Aug. 2003, pp. 1-12.
Bachmayer et al., *Underwater Gliders: Recent Developments and Future Applications*, 2004, pp. 1-6.

* cited by examiner

*Primary Examiner*—Sherman Basinger
(74) *Attorney, Agent, or Firm*—Pate Pierce & Baird

(57) ABSTRACT

An apparatus for underwater propulsion. The apparatus may include a hydrofoil, a buoyancy compensator connected to the hydrofoil, a tank containing air, and a controller regulating the passage of air from the tank into the buoyancy compensator. The controller may also regulate the escape of air from the buoyancy compensator. By positioning the hydrofoil underwater and alternating between positive and negative angles of attack, a diver may generate forward propulsion by manipulating the controller to correspondingly alternate the buoyant force produced by the buoyancy compensator between levels below and above neutral buoyancy.

26 Claims, 18 Drawing Sheets

BUOYANCY-BASED, UNDERWATER PROPULSION SYSTEM AND METHOD

BACKGROUND

1. The Field of the Invention

This invention relates to underwater propulsion and, more particularly, to novel systems and methods for using buoyancy-based, vertical forces to generate forward motion.

2. The Background Art

In the early 1940's, Jacques-Yves Cousteau and Emile Gagnan developed a regulator that automatically provided compressed air to a diver in response to inhalation. Prior to the Cousteau-Gagnan regulator, all self-contained underwater breathing devices supplied air continuously or required manual manipulation between on and off configurations. The Cousteau-Gagnan regulator begin a diving revolution that brought reliable and low cost diving to the masses. In 1993, just fifty years after the invention of the Cousteau-Gagnan regulator, the Professional Association of Diving Instructors (PADI) certified 515,000 new divers worldwide.

In recent years, the popularity of other underwater diving activities such as snorkeling has also grown. With the increasing interest in underwater diving, systems and methods have been developed to assist divers in propelling themselves through the water. For example, high efficiency swim fins such as those disclosed in U.S. Pat. No. 6,607,411 B1 issue Aug. 19, 2003 to McCarthy have been developed. Such fins allegedly increase lift and decrease the turbulence and drag imposed. Development in other directions has lead to improvements in personal, motor-driven craft (e.g. scooters, tractors), such as that disclosed in U.S. Pat. No. 6,647,912 B1 issued Nov. 18, 2003 to Rogers. Such devices pull a user through the water and may be steered by pointing the craft in the direction the user desires to travel.

However, certain areas or sources of underwater propulsion have been under utilized. For example, buoyancy forces have not been adequately tapped to provide personal, underwater propulsion. Accordingly, what is needed is a buoyancy-based, underwater propulsion system and method to assist divers of all type in travels through the water.

BRIEF SUMMARY OF THE INVENTION

In view of the foregoing, in accordance with the invention as embodied and broadly described herein, a method and apparatus are disclosed in one embodiment of the present invention as including a hydrofoil with a buoyancy compensator connected thereto. In selected embodiments, a buoyancy compensator may include a tank containing air (i.e. a collection of one or more gases), a controller, and an expander. The controller may regulate both the passage of air from the tank into the expander and the escape of air from the expander to the surrounding environment.

A diver may equip herself with the hydrofoil and buoyancy compensator before entering the water. Once underwater, the diver may use the buoyancy compensator to control the buoyant force acting on herself and her equipment. That is, by injecting air into the expander, the volume occupied by the expander may increase without increasing the overall mass of the diver, hydrofoil, and buoyancy compensator. In such a manner, the buoyant force acting on the diver and her equipment may increase, causing her to rise. Conversely, by dumping air from the expander, the volume occupied by the expander may decrease. Accordingly, the buoyant force acting on the diver and her equipment may decrease, causing her to sink.

Sailboats have sails to catch the wind and a keel or dagger board to resist. Just as wind in a sail pushes a boat partly sideways and partly forward, buoyant forces can push a driver partly upward and partly forward. By properly directed resistance from a keel, dagger board, or equivalent, a wind force or buoyant force yields a forward force vector.

A diver may use a hydrofoil in accordance with the present invention to generate forward propulsion from the vertical rising or sinking caused by a buoyancy compensator. For example, when rising, a diver may orient the hydrofoil to a positive angle of attack. Differentials in the drag imposed on the hydrofoil by the water may urge the diver and hydrofoil forward. Similarly, when sinking, a diver may orient the hydrofoil to a negative angle of attack. Again, differentials in the drag (upward/downward=high drag; forward/backward=low drag) imposed on the projected relative shapes and sizes of the hydrofoil by the water may urge the diver and hydrofoil forward.

In selected embodiments, a buoyancy compensator in accordance with the present invention may include a vest containing one or more expanders. In some embodiments, expanders may comprise inflatable bladders. In such embodiments, an inflator having actuators (e.g. levers, knobs, buttons, etc.) for manually regulating the flow of air to and from the inflatable bladders may function as a controller. In other embodiments, a buoyancy compensator may include one or more expanders positioned within a cavity formed inside a hydrofoil. In such embodiments, the hydrofoil and buoyancy compensator may be integrated into a single unit. The hydrofoil may expand and contract, or air and water may be selectively introduced and purge inside it.

A buoyancy compensator embodied as a vest may include a tank cradle securing a tank to the vest. If desired, a hydrofoil may be secured to a tank, which, in turn, may be secured to the cradle of the vest. Alternatively, the hydrofoil may secure directly to the cradle or to the vest itself. In yet another embodiment, a hydrofoil may be held in the hands of the diver.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in the Figures, is not intended to limit the scope of the invention, as claimed, but is merely representative of selected embodiments of apparatus made in accordance with the invention. The invention will be best understood by reference to the drawings, wherein like parts are designated by like numerals throughout.

Figure 1:
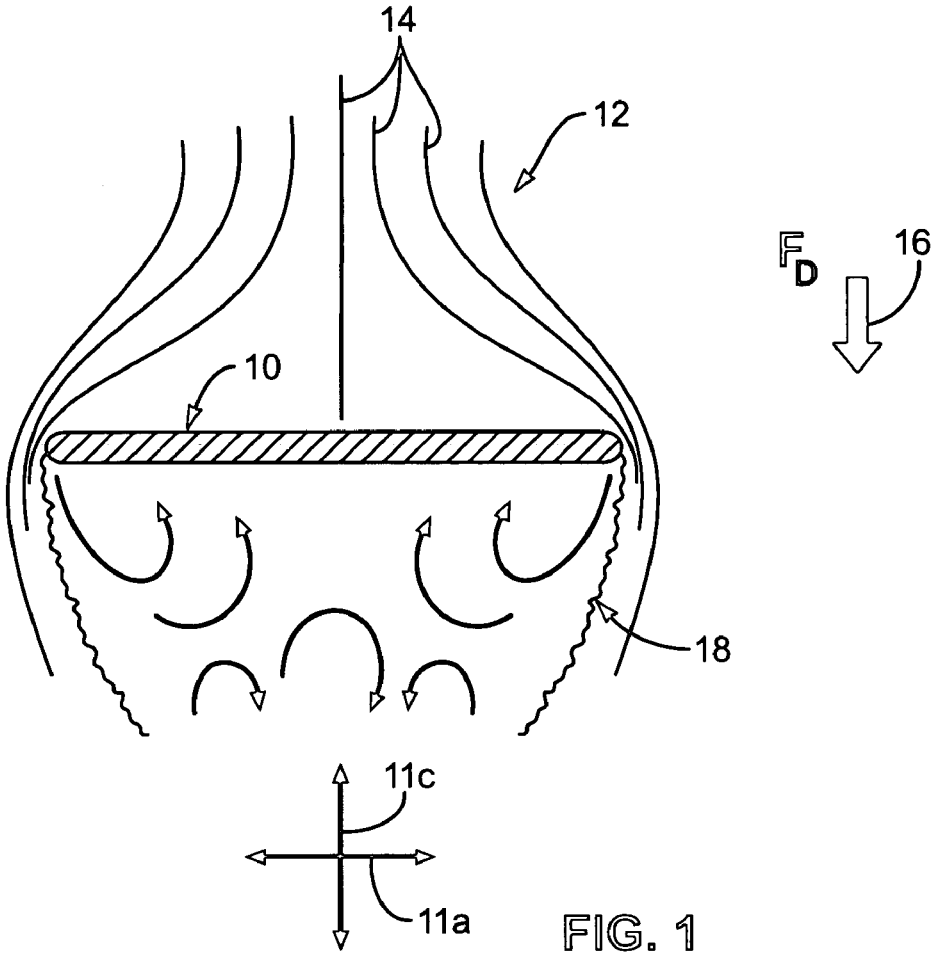
FIG. 1 is a side elevation view of a flat plate subjected to a transverse flow resulting in a large wake and corresponding high drag.
Figure 2:
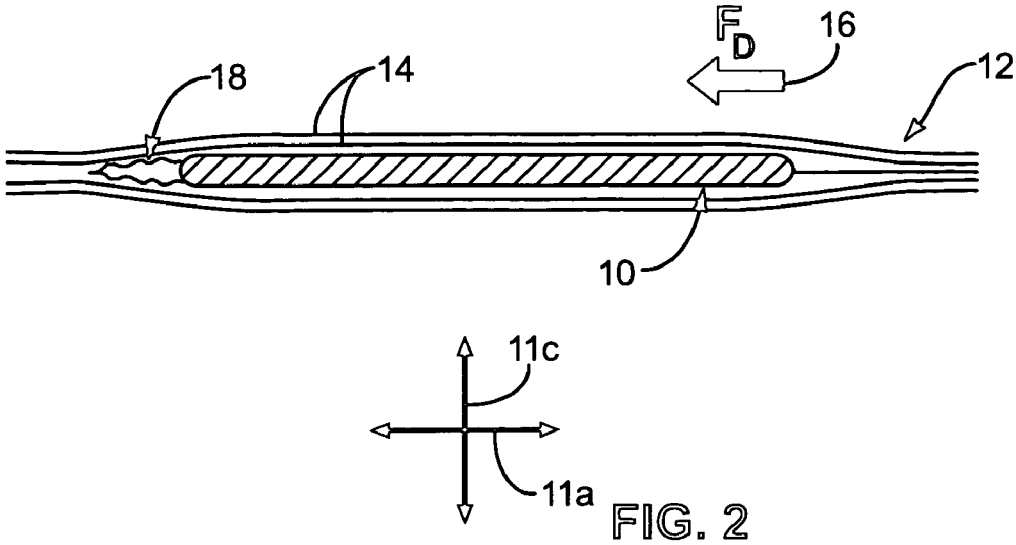
FIG. 2 is a side elevation view of the flat plate of FIG. 1 subjected to a longitudinal flow resulting in a small wake and corresponding low drag.

Referring to FIGS. 1 and 2, the shape and orientation of a body 10 placed within a flow 12, illustrated using streamlines 14, dramatically affect the drag 16 or resistance force 16 imposed on the body 10 by the flow 12. For example, a body 10 placed within a flow 12 generates a wake 18 or separation region 18. The size of the wake 18 generally corresponds to the drag 16 imposed. Accordingly, by shaping or orienting a body 10 to maximize the wake 18 produced, drag 16 may be maximized. Similarly, by shaping or orienting a body 10 to minimize the wake 18 produced, drag 16 may be minimized.

To further illustrate, a coordinate axis system may be defined by a longitudinal direction 11*a*, lateral direction 11*b*, and transverse direction 11*c* substantially orthogonal to one another. A body 10 may comprise a substantially flat plate 10 aligned with the longitudinal and lateral directions 11*a*, 11*b*. A flow 12 moving with respect to the plate 10 in the transverse direction 11*c* may impinge perpendicularly thereon. In such an arrangement, a relatively large wake 18 may be generated. As a result, the drag 16 imposed on the plate 10 may be relatively large.

The same flat plate 10 may be oriented in parallel with the flow 12. That is, the plate 10 may still align with the longitudinal and lateral directions 11*a*, 11*b*, but the flow 12 may be introduced from the longitudinal direction 11*a*. In such an arrangement, a relatively small wake 18 may be generated. As a result, the drag 16 imposed on the plate 10 may be relatively small. The drag 16 imposed on a flat plate 10 oriented in parallel with the flow 12 may be orders of magnitude less than the drag 16 imposed on a flat plate 10 oriented perpendicular to the flow 12.

In general, a body 10 may be characterized by its shape or orientation with respect to a flow 12. For example, depending on its propensity to generate a wake 18, (shape and extent of separation zone 18, or recirculation zone 18) a body 10 may be characterized as a bluff body or a streamlined body. A body 10 that generates a significant wake 18 when placed in a flow 12 may generally be considered to be a bluff body. A flat plate 10 oriented perpendicularly with respect to a flow 12 may be a good example of a bluff body. On the other hand, a body 10 that generates a little or no wake 18 when placed in a flow 12 may generally be considered to be a streamlined body. A flat plate 10 oriented parallel to a flow 12 may be considered a streamlined body, especially where the thickness is one or more orders of magnitude less than its length.

Figure 3:
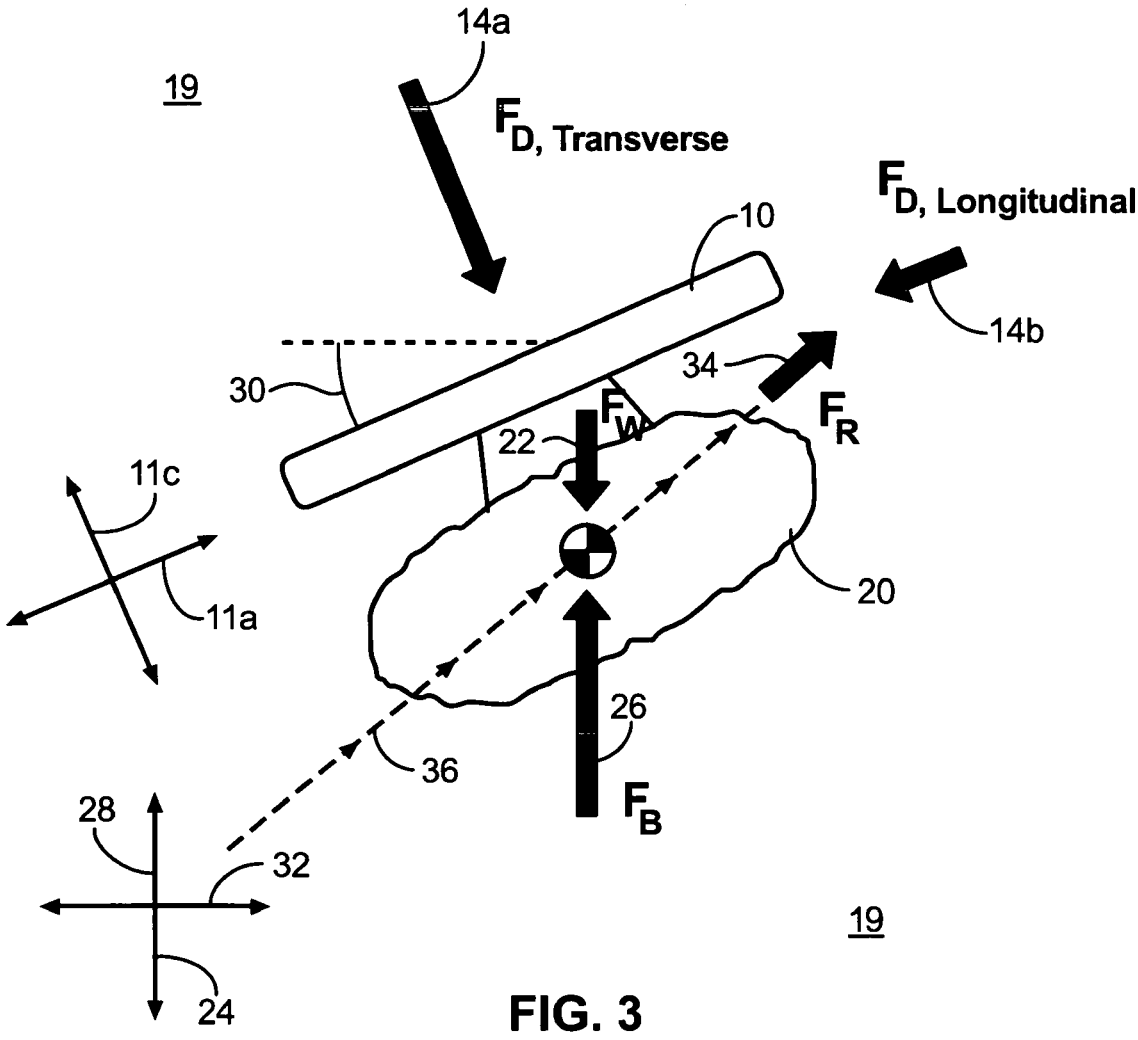
FIG. 3 is a side elevation, free-body diagram of a hydrofoil secured to a mass in accordance with the present invention.

Referring to FIG. 3, in selected embodiments, a body 10 may be a hydrofoil 10. A hydrofoil 10 in accordance with the present invention may be any structure that acts as a bluff body when encountering flows 12 in one direction and substantially as a streamline body when encountering flows 12 in another direction. For example, coordinate axes 11*a*,

11*b*, 11*c* may be oriented with respect to a hydrofoil 10. Accordingly, a hydrofoil 10 may be shaped and sized to substantially act as a bluff body to flows 12 in the transverse direction 11*c* and as a streamlined body to flows 12 in the longitudinal direction 11*a*.

When placed within a fluid 19, a hydrofoil 10 may use vertically acting forces to generate horizontal motion. For example, in selected embodiments, a hydrofoil 10 may be secured to a mass 20. Together, the hydrofoil 10 and mass 20 may be accelerated by gravity to generate a weight force 22 tending to pull the combination 10, 20 down 24. On the other hand, a buoyant force 26, equal to the weight of the fluid 19 displaced by the combination 10, 20, may tend to push the hydrofoil 10 and mass 20 up 28. Accordingly, when the net density of the hydrofoil 10 and mass 20 is less than the density of the fluid 19, the combination 10, 20 will tend to rise 28. Conversely, when the net density of the hydrofoil 10 and mass 20 is greater than the density of the fluid 19, the combination 10, 20 will tend to sink 24.

In situations where the net density of the hydrofoil 10 and mass 20 is not equal to the density of the fluid 19, the hydrofoil 10 and mass 20 will tend to sink 24 or rise 28 against the drag 14 imposed by the fluid 19 on the hydrofoil 10 and mass 20. For simplicity, the drag 14 imposed on the combination 10, 20 may be divided into components of transverse drag 14*a* and longitudinal drag 14*b*.

When the hydrofoil 10 and mass 20 are positioned substantially horizontally, vertical motion caused by an imbalance between the weight force 22 and the buoyant force 26 will generate a movement upward of the hydrofoil and thus a relative flow 12 in the transverse direction 11*c*. A flow in the transverse direction 11*c* may encounter a hydrofoil 10 as a bluff body and produce a relatively high transverse drag 14*a*. Accordingly, the motion of the hydrofoil 10 (oriented to present comparatively large area and high drag) and mass 20 up 28 or down 24 may be comparatively quite slow.

However, in certain situations in accordance with the present invention, a hydrofoil 10 may be positioned at an angle of attack 30 with respect to the horizontal direction 32. An imbalance in the vertical forces 22, 26 (e.g. an increase in the buoyant force 26) may then cause a vertical component of motion. Once relative vertical motion (e.g. foil 10 with the respect to water) is initiated in any direction, drag 14 is generated in an opposite direction. However, as a result of the angle of attack 30, vertical component of motion up 28 or down 24 is no longer opposed directly by the large transverse drag 14*a*. Rather, a summation of the weight force 22, buoyant force 26, transverse drag 14*a* and longitudinal drag 14*a* may identify a resultant force 34 or force vector 34 having a horizontal component.

Due to the large disparity between the orders of magnitude of the transverse drag 14*a* and longitudinal drag 14*b* imposed by the fluid 19 on the hydrofoil 10, the resultant force 34 may largely act in the longitudinal direction 11*a*. Accordingly, the hydrofoil 10 and mass 20 may accelerate along a path 36 extending primarily in the longitudinal direction 11*a* until the longitudinal drag 14*b* increases to equal the resultant force 34. In general, the greater the transverse drag 14*a* of the combination 10, 20 when compared to the longitudinal drag 14*b* thereof, the more the path 36 of the combination 10, 20 tends to align with the longitudinal direction 11*a*. If the effective center, or centeroid, of a buoyant force, do not align substantially with that of the drag forces then an apparatus 10 may rotate subject to a "couple" formed by the two forces. Thus improved operational stability may result by designing these two centroids to coincide. Likewise, the centroids of longitudinal forces may benefit by being aligned as closely as possible (e.g. buoyancy, weight, drag, etc.).

Accordingly, a hydrofoil 10 and mass 20 combination presenting a very bluff profile in the transverse direction 11*c* and a very streamlined profile in the longitudinal direction can convert small angles of attack 30 and small imbalances in the vertical forces 22, 26 into significant velocities along a path extending substantially in the longitudinal direction 11*a*. In that the angle of attack 30 defines the angle between the longitudinal direction 11*a* and the horizontal direction 32 or horizontal plane 32, small angles of attack 30 allow such velocities to largely be directed in the horizontal direction 32. As a result, significant forward propulsion may be extracted from buoyancy forces that would otherwise yield simple up 28 and down 24 motion.

Figure 4:
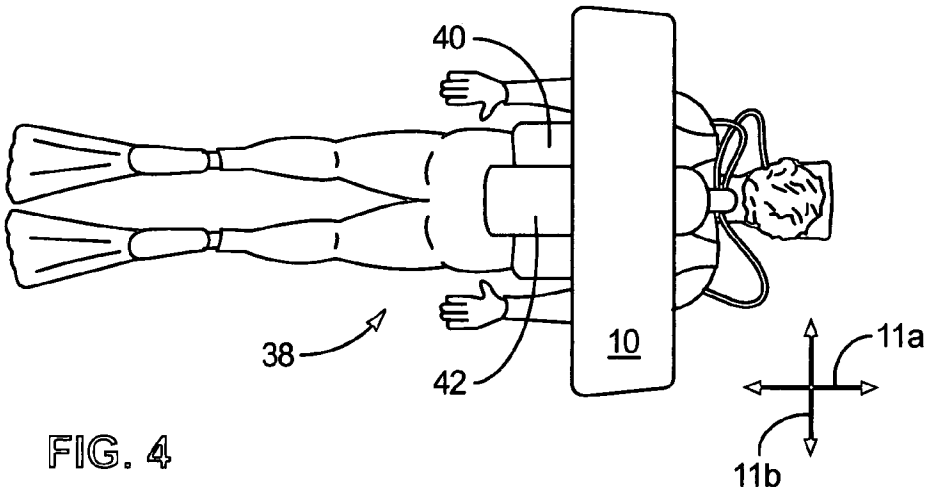
FIG. 4 is top plan view of a diver and hydrofoil in accordance with the present invention.
Figure 5:
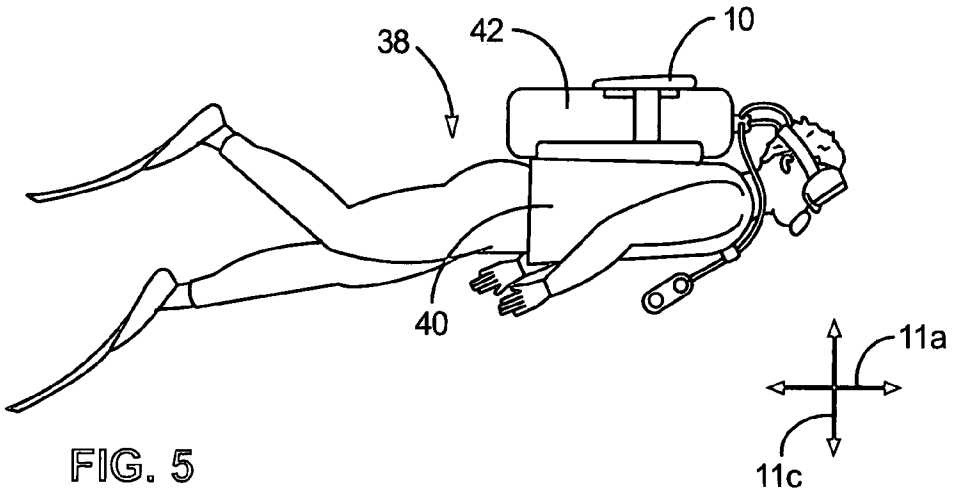
FIG. 5 is a side elevation view of the diver and hydrofoil of FIG. 4.
Figure 6:
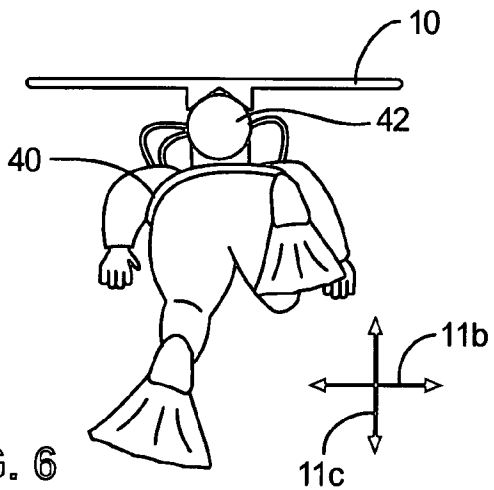
FIG. 6 is an end elevation view of the diver and hydrofoil of FIG. 5.

Referring to FIGS. 4-6, in selected embodiments, a hydrofoil 10 in accordance with the present invention may be used by a diver 38 (e.g. scuba diver, skin diver, snorkeler, swimmer, etc.). A hydrofoil 10 may be held by the diver 38, secured to the equipment of the diver 38, or the like. For example, a diver 38 may wear a scuba vest 40, commonly referred to as a buoyancy compensator (BC) or buoyancy control device (BCD). The vest 40 may secure a tank 42 of breathing air to the back of a diver 38. A hydrofoil 10 in accordance with the present invention may secure to the vest 40 or to the tank 42. So positioned, the hydrofoil 10 may be outside the diver's 38 field of view. Additionally, by securing the hydrofoil 10 to the equipment 40, 42 on the diver's back, the diver 38 may maintain full use of her arms and legs.

Figure 7:
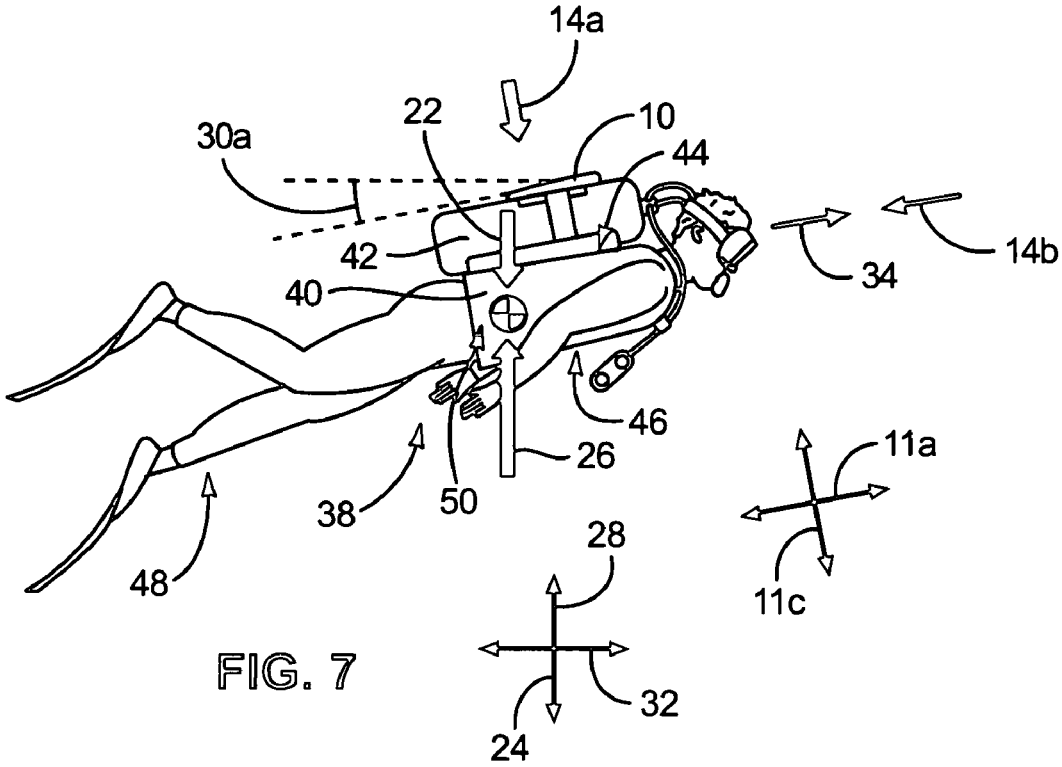
FIG. 7 is a side elevation, free-body diagram of a diver and hydrofoil oriented at a positive angle of attack in accordance with the present invention.

Referring to FIG. 7, with a hydrofoil 10 secured to, held by, or otherwise fixedly connected to a portion of a diver 38, the combination of the hydrofoil 10 and the diver 38 may behave as the hydrofoil 10 and mass 20 described hereinabove. That is, when the net density of the hydrofoil 10 and diver 38 is less than the density of the fluid 19 (e.g. sea water, fresh water, etc.), the combination 10, 38 will tend to rise 28. Conversely, when the net density of the hydrofoil 10 and diver 38 is greater than the density of the fluid 19, the combination 10, 38 will tend to sink 24. To the extent that centroids of opposing forces are substantially aligned, the direction of net motion resulting is substantially stable to that extent.

The net density of the a hydrofoil 10 and a diver 38 may be controlled in any suitable manner. For example, in selected embodiments a buoyancy compensator 44 may be connected to the diver 38, diver's equipment 40, 42, hydrofoil 10, or the like. In certain embodiments, a buoyancy compensator 44 may be formed by connecting a source of air (i.e. any collection of one or more gases) to an expander such as an inflatable bladder, piston and cylinder, purge tank, or the like. To decrease the net density, air may be passed from the source (e.g. typically a pressurized tank) into the expander. The expander may expand and increase the volume or alternatively purged aligned volume (e.g. interior of foil 10) occupied by the diver 38 and his equipment 10, 40, 42, 44. Because the mass (or alternatively, volume) of the diver 38 and equipment 10, 40, 42, 44 does not change with the change in overall volume (or alternatively, mass), the net density changes. To increase the net density, air may be dumped from a volume adjuster or purged by water in a fixed volume. Alternatively, density may decrease with addition of air into a volume adjuster or purging of water from a fixed volume by air replacing that water.

A source of air may be the tank 42 containing the breathing air. Alternatively, an auxiliary tank may form the source of air portion of the buoyancy compensator 44. Such an arrangement may avoid unwanted depletion of breathing air. For example, a "pony bottle" may supple air to the buoyancy compensator 44 while the main tank 42 supplies the breathing air. If desired, an auxiliary tank may be connected and equipped to selectively provide air to a diver 38 or air for the buoyancy compensator 44.

A buoyancy compensator 44 may be connected to a diver 38 in any suitable manner. In selected embodiments, a buoyancy compensator 44 may be placed within a hydrofoil 10. In other embodiments, a buoyancy compensator 44 may be connected to the diver 38. For example, in certain embodiments, a buoyancy compensator 44 may be built into a vest 40 worn by the diver 38. As mentioned hereinabove, such vests 40 are themselves commonly referred to as buoyancy compensators or buoyancy control devices (BCD).

For purposes of the present disclosure, a buoyancy compensator 44 may refer to any device capable of selectively increasing and decreasing a buoyant force 26. This definition may be applied regardless of whether the device is actually embodied as a vest 40 to be worn by a scuba diver. Accordingly, a buoyancy compensator 44, as used in the present disclosure, is broader and more inclusive than the vest-based embodiments to which the term may be applied at a scuba shop or the like.

Underwater, a diver 38 desiring to travel horizontally will generally position herself horizontally. In such a position, the buoyancy compensator 44 may be selectively operated to cause an increase or decrease in the buoyancy-force 26 acting on the diver 38 and her equipment 10, 40, 42, 44. If the hydrofoil 10 is positioned exactly horizontally, the motion of the hydrofoil 10 and diver 28 up 28 or down 24 may be quite slow. However, if the hydrofoil 10 is oriented at an angle of attack 30, a forward (i.e. horizontal 32) component of motion may be initiated.

For example, prior to altering the buoyant force 26, a diver 38 may orient the hydrofoil 10 at a positive angle of attack 30*a*. A positive angle of attack 30*a* may be defined as an angle formed by the hydrofoil 10 above a line extending in the horizontal direction 32. Once the desired positive angle of attack 30*a* is achieved, the buoyant force 26 acting on the diver 38 and her equipment 10, 40, 42, 44 may be increased by selectively operating the buoyancy compensator 44. Such an increase in the buoyant force 26 will typically urge a vertical motion.

Once vertical motion is initiated, drag 14 is generated. Due to the positive angle of attack 30*a*, vertical motion up 28 is no longer opposed directly by the large transverse drag 14*a*. Rather, a summation of the weight force 22, buoyant force 26, transverse drag 14*a* and longitudinal drag 14*a* may identify a resultant force 34 having a horizontal component.

Due to the large disparity between the transverse drag 14*a* and longitudinal drag 14*b* imposed by the surrounding water on the hydrofoil 10, the resultant force 34 may largely act in the longitudinal direction 11*a*. Accordingly, the hydrofoil 10 and diver 38 may accelerate in primarily the longitudinal direction 11*a* until the longitudinal drag 14*b* increases to equal the resultant force 34.

In selected embodiments, the positioning of the buoyancy compensator 44 may provide a mechanism for automatic orientation of the hydrofoil 10 to a desired angle of attack 30. Portions of a diver 38 or her equipment 10, 40, 42 to which a buoyancy compensator 44 connects may tend to rise or fall quicker than portions spaced from the buoyancy compensator 44. For example, in certain embodiments, a buoyancy compensator 44 may include one or more inflatable bladders built into a vest 40 worn about the torso 46 of the diver 38. When air is injected into the inflatable bladders, the torso 46 of the diver 38 may begin to rise. The legs 48 of the diver 38, however, have not changed in density and may not immediately be motivated to rise. Accordingly, the legs 48 may tend to lag behind the torso 46. As a result, the diver 38 may rotate in the water and thereby position the hydrofoil 10 at a positive angle of attack 30*a*. Once a positive angle of attack 30*a* is achieved forward motion of the diver 38 may be induced.

In certain situations, it may be desirable to limit the angle of attack 30 of a diver 38 employing a hydrofoil 10 in accordance with the present invention. For example, if a positive angle of attack 30*a* is too large, a diver 38 may travel up 28 more than desired relative to the movement in a horizontal direction 32. Rapid changes in vertical position may be fatal to a diver 38 if not properly controlled. Accordingly, a diver 38 may use arms and legs 48 to control the angle of attack 30 by generating appropriate rotation of the hydrofoil 10 about an axis extending in the lateral direction 11*b*.

Figure 8:
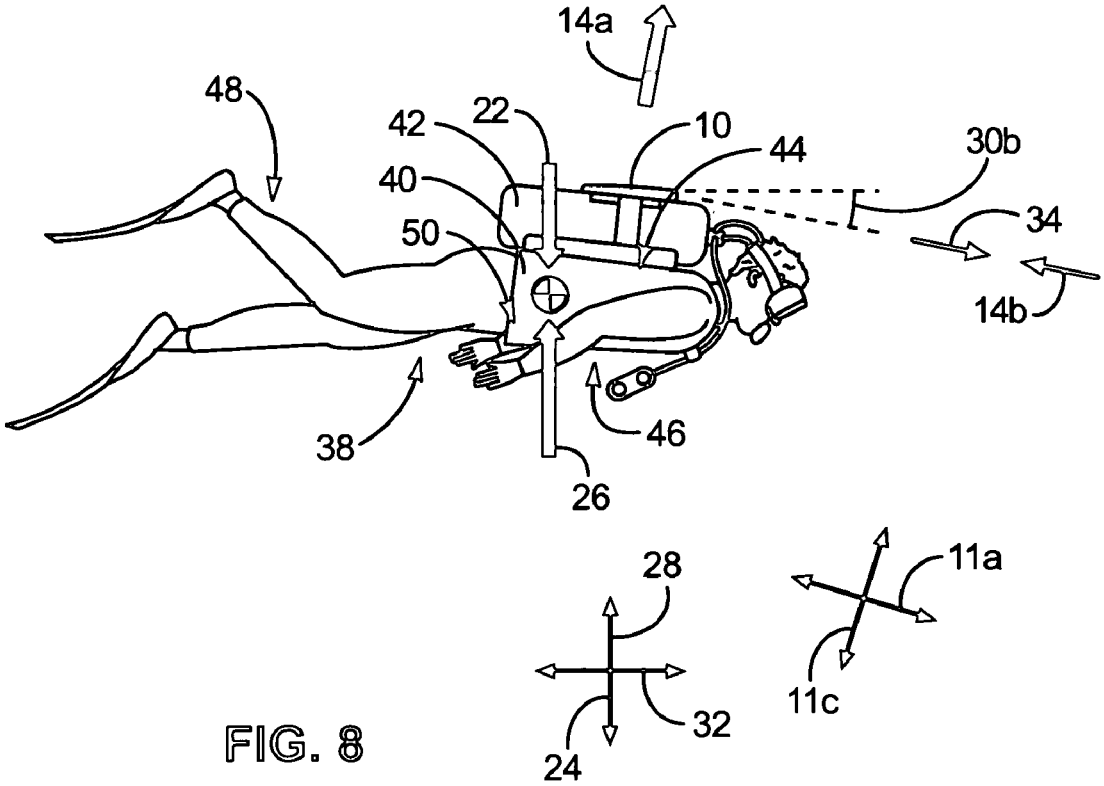
FIG. 8 is a side elevation, free-body diagram of a diver and hydrofoil oriented at a negative angle of attack in accordance with the present invention.

Referring to FIG. 8, once a diver 38 has risen to a desired height or traveled a desired distance forward, the buoyancy compensator 44 may be automatically or manually selectively adjusted to neutral buoyancy. Neutral buoyancy is a condition where in the net density of the diver 38 and her equipment 10, 40, 42, 44 is equal to the net density of the surrounding fluid. At neutral buoyancy, the weight force 22 is equal to the buoyant force 26, the motivation for vertical motion disappears, and the diver 38 soon comes to a stop.

Once a maximum height is achieved, if additional travel in the horizontal direction 32 is desired, a process somewhat the reverse of that described hereinabove may be followed. That is, a diver 38 may orient the hydrofoil 10 to a negative angle of attack 30*b*. A negative angle of attack 30*b* may be defined as an angle formed by the hydrofoil 10 below a line extending in the horizontal direction 32. Once the desired negative angle of attack 30*b* is achieved, the buoyant force 26 acting on the diver 38 and her equipment 10, 40, 42, 44 may be decreased by selectively operating the buoyancy compensator 44. Such an decrease in the buoyant force 26 may initiate motion downward 24.

Once motion downward 24 is initiated, drag 14 is generated. Again, due to the negative angle of attack 30*a*, vertical motion down 24 is no longer opposed directly by the large transverse drag 14*a*. Rather, a summation of the weight force 22, buoyant force 26, transverse drag 14*a* and longitudinal drag 14*a* may identify a resultant force 34 with a horizontal component.

As stated hereinabove, the large disparity between the transverse drag 14*a* and longitudinal drag 14*b* imposed by the surrounding water on the hydrofoil 10, the resultant force 34 may largely act in the longitudinal direction 11*a*. Accordingly, the hydrofoil 10 and diver 38 may accelerate in primarily the longitudinal direction 11*a* until the longitudinal drag 14*b* increases to equal the resultant force 34.

As with orientations to a positive angle of attack 30*a*, positioning the buoyancy compensator 44 may provide a mechanism for automatic orientation of the hydrofoil 10 to a desired negative angle of attack 30*a*. For example, in certain embodiments, a diver 38 may wear a weight belt about the waist 50 and a vest 40 containing one or more inflatable bladders. When air is dumped from the inflatable bladders, the weight belt, as well as the other equipment (e.g. tank 42) secured to the torso 46 of the diver 38, may cause the torso 46 to sink faster than the legs 48. As a result, the diver 38 may rotate in the water and thereby position the hydrofoil 10 at a negative angle of attack 30*b*. Once a negative angle of attack 30*b* is achieved forward motion of the diver 38 may be induced to begin or continue.

Figure 9:
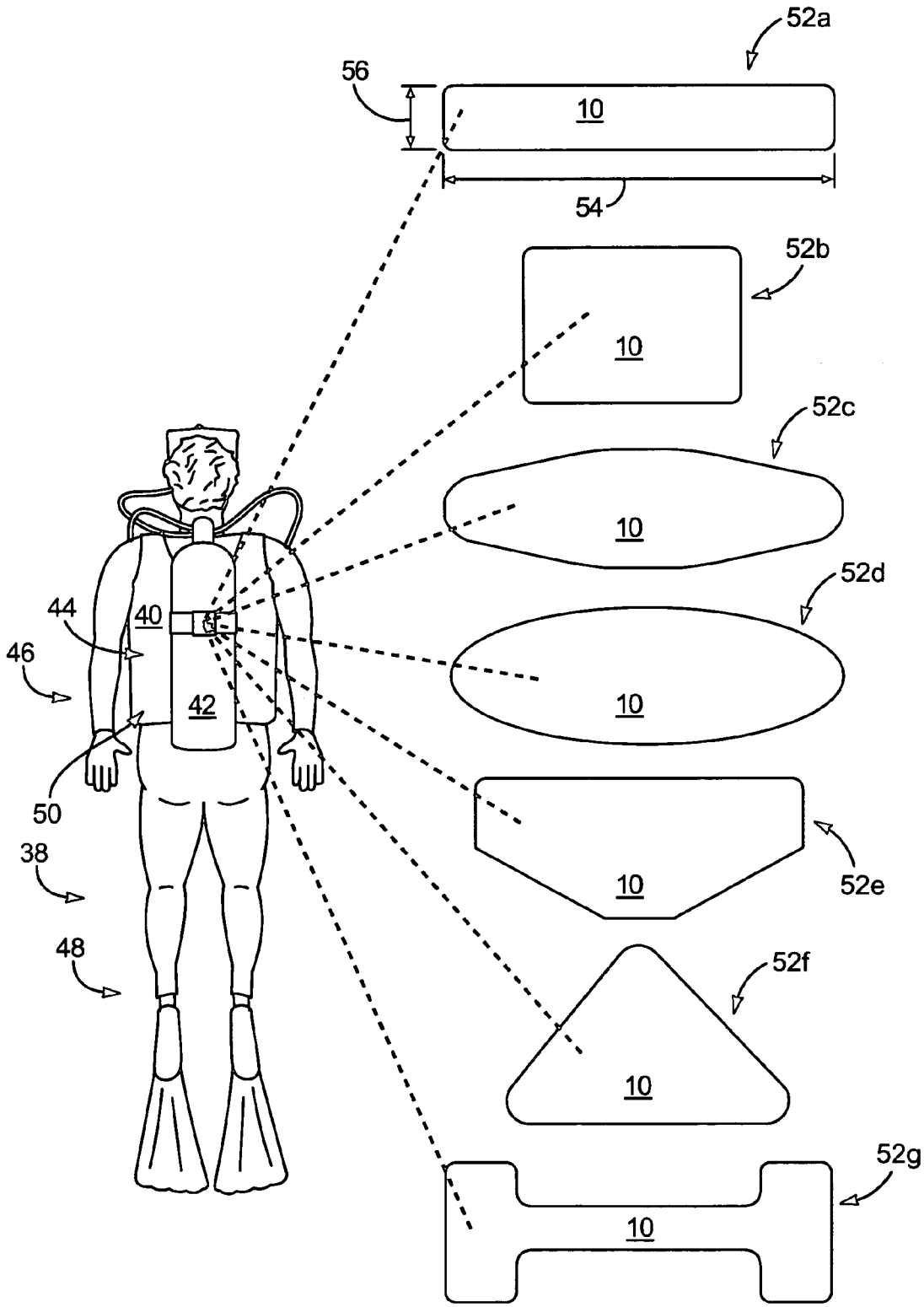
FIG. 9 is a top plan view of a sampling of various alternative hydrofoil shapes that may be used by a diver in accordance with the present invention.

Referring to FIG. 9, a hydrofoil 10 in accordance with the present invention may have any suitable top plan shape 52. Considerations that may be taken into account when selecting the shape 52 of a hydrofoil 10 may include ease of manufacture, cost, wing area, stability in motion, drag characteristics, strength, rigidity, and the like. Suitable shapes 52 may include elongated rectangles 52*a*, short rectangles 52*b* or squares 52*b*, tapers 52*c*, ellipses 52*d*, forward or rearward tapers 52*e*, deltas 52*f*, irregular or unconventional shapes 52*g*, and the like.

An additional consideration that may be taken into account when selecting a shape 52 for a hydrofoil 10 may be the interest the shape 52 generates in aquatic life passing thereby. For example, a shape 52 that attracts the interest sharks may be undesirable. Accordingly, in selected embodiments, it may be desirable to select a shape 52 that does not resemble the profile of fins or flippers of something a shark may view as food. In such embodiments, hydrofoils 10 of an irregular or unconventional shape 10*g* may be particularly useful.

Due to the difference in density between water and air, the wing area of hydrofoil 10 used in accordance with the present invention may be much less that the wing area required for an airfoil supporting the same mass. A hydrofoil 10 need only have a wing area sufficient to bias the combination of a diver 38 and hydrofoil 10 toward motion in the longitudinal direction 11*a* over motion in the transverse direction 11*c*. Suitable wing areas for a hydrofoil 10 may range from a two to five square feet. However, larger or smaller wing areas may be suitable depending on the drag 14 imposed by the water on the diver 38 and her equipment 40, 42, 44. Generally, the greater the longitudinal drag 14*b* generated by diver 38 and her equipment 40, 42, 44 when compared to the transverse drag 14*a* on the same 38, 42, 44, the greater the required wing area for the hydrofoil 10.

The wing span 54 of a hydrofoil 10 in accordance with the present invention may vary depending on the desired chord length 56 and wing area. For example, a hydrofoil 10 having a large wing span 54 and a short chord length 56 may provide the same wing area as a hydrofoil 10 having a short wing span 54 but a longer chord length 56.

Figure 10:
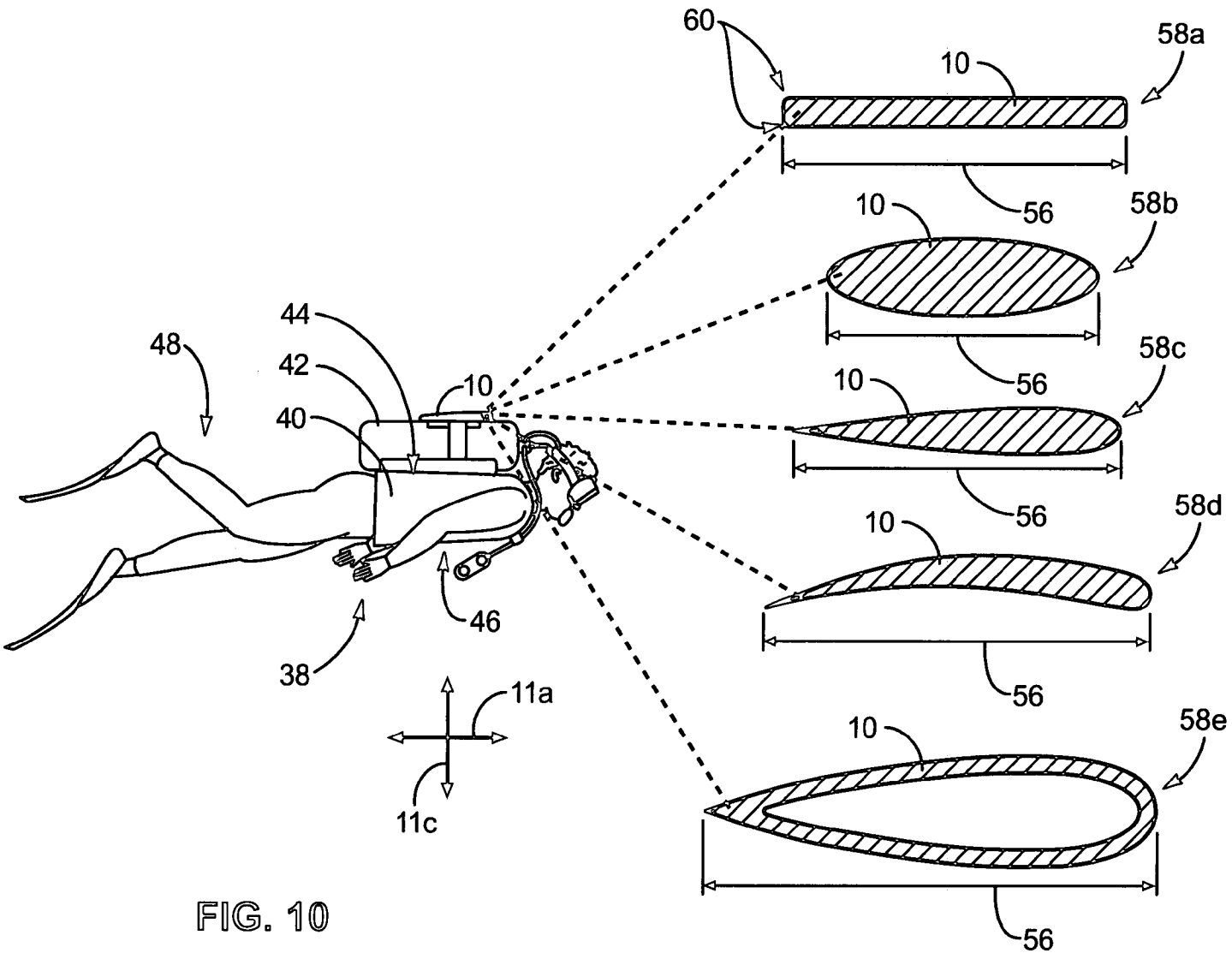
FIG. 10 is a side elevation view of various alternative hydrofoil cross-sections that may be used by a diver in accordance with the present invention.

Referring to FIG. 10, a hydrofoil 10 in accordance with the present invention may have any suitable cross-section 58. Similar to selecting a shape 52 for a hydrofoil 10, considerations that may be taken into account when selecting the cross-section 58 of a hydrofoil 10 may include ease of manufacture, cost, chord length 56, stability in motion, drag characteristics, strength, rigidity, and the like. Suitable cross-sections 58 may be rectangular 58*a* or rectangular 58*a* with rounded corners 60, elliptical 58*b*, streamlined 58*c*, cambered 58*d*, hollow 58*e*, and the like.

In general, any cross-section 58 providing a low-drag, substantially streamlined profile for flows in the longitudinal direction 11*a* and a high-drag, bluff profile for flows in the transverse direction 11*c* may be sufficient. If desired, the cross-section 58 of a hydrofoil 10 may vary across the wing span 54. For example, cross-sections 58 may vary in chord length 56, shape, or the like as desired or necessary.

A hydrofoil 10 in accordance with the present invention may be formed of any suitable material or combination of materials. The material or materials for a hydrofoil 10 may be selected to provide desired strength, toughness, rigidity, workability, cost, water resistance, density, and the like. Suitable materials may include woods, metals, metal alloys, polymers, reinforced polymers, composites, and the like. In one embodiment, a hydrofoil 10 in accordance with the present invention is molded, from a polymer, with metallic inserts to increase the net density of the resulting unit.

Figure 11:
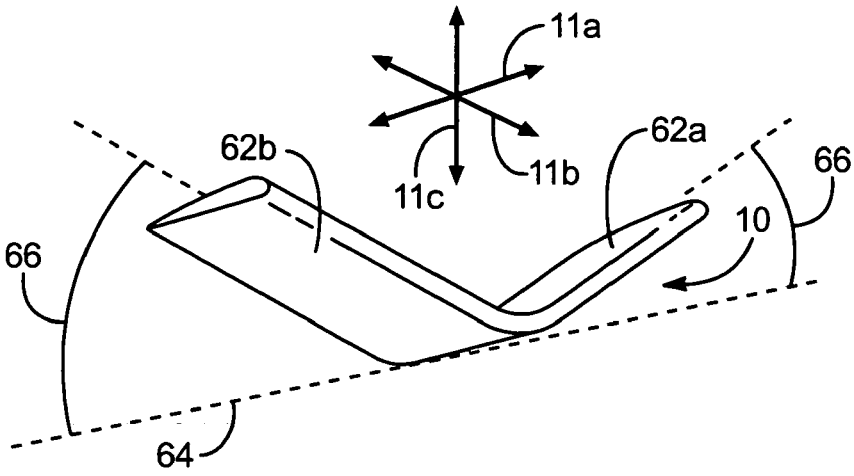
FIG. 11 is a perspective view of a hydrofoil with a dihedral angle in accordance with the present invention.

Referring to FIG. 11, a hydrofoil 10 in accordance with the present invention may be formed with a dihedral. That is, for example, left and right ends 62*a*, 62*b* of a hydrofoil 10 may extend up in the transverse direction 11*c* away from a line 64 extending in the lateral direction 11*b*. The dihedral may be quantified in terms of the angle 66 formed between the left and right ends 62*a*, 62*b* of a hydrofoil 10 and the laterally 11*b* extending line 64. In general, the more dihedral the hydrofoil 10 has (i.e. the greater the angle 66), the more it will tend to self-right as it descends. Accordingly, a diver 38 may have an easier time maintaining the hydrofoil 10 level. However, excessive dihedral may tend to destabilize the hydrofoil 10 on ascent. It is within contemplation to make the dihedral angle adjustable, even reversible in some embodiments, to allow stabilization selectively for both up and down transit.

Figure 12:
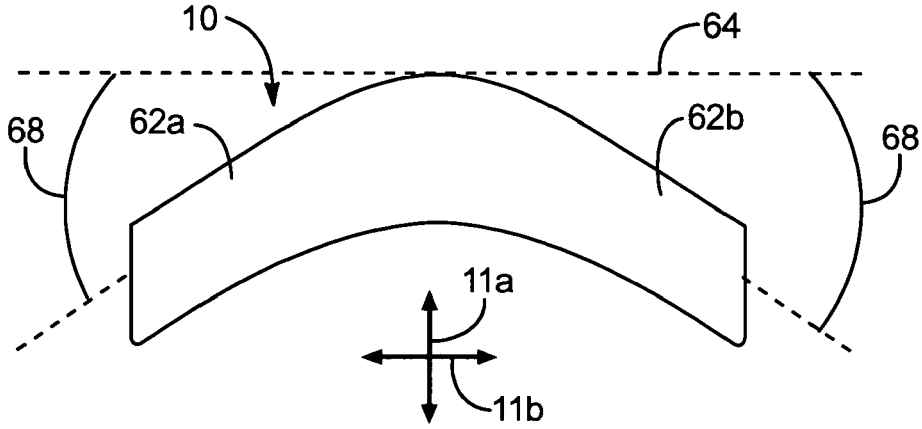
FIG. 12 is a top plan view of a hydrofoil swept back in accordance with the present invention.

Referring to FIG. 12, a hydrofoil 10 in accordance with the present invention may be swept back. That is, the left and right ends 62*a*, 62*b* of a hydrofoil 10 may extend back in the longitudinal direction 11*a* away from the line 64 extending in the lateral direction 11*b*. A sweep angle 68 may be defined as the angle 68 formed between the left and right ends 62*a*, 62*b* of a hydrofoil 10 and the laterally 11*b* extending line 64. Similar to a dihedral, sweeping a hydrofoil 10 back tends to increase the dynamic stability thereof. Unlike an upward dihedral, sweeping a hydrofoil 10 back tends to increase stability on ascent as well as descent.

Figure 13:
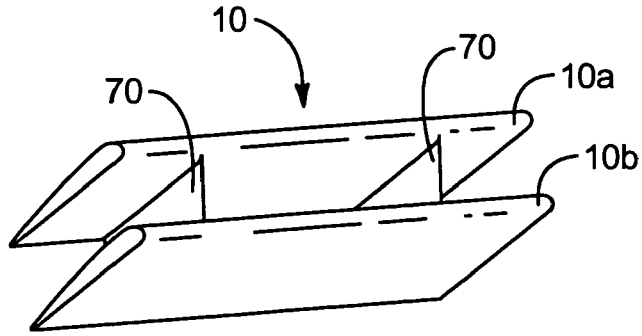
FIG. 13 is a perspective view of a stacked hydrofoil in accordance with the present invention.

Referring to FIG. 13, in selected embodiments, a stacked hydrofoil 10 may be formed by positioning one sub-hydrofoil 10*a* on top of another 10*b*. For example, an upper hydrofoil 10*a* may be positioned above a lower hydrofoil 11*b*. A stacked hydrofoil 10 in accordance with the present invention may include two or more sub-hydrofoils 10*a*, 10*b*. Relative positioning between sub-hydrofoils 10*a*, 10*b* may be maintained by one or more struts 70. By stacking sub-hydrofoils 10*a*, 10*b*, wing area may be increased without increasing the wing span 54 or the chord length 56. A stacked hydrofoil 10 may be useful in situations where greater transverse drag 14*a* is needed, but increasing the wing span 54 or chord length 56 is undesirable.

Figure 14:
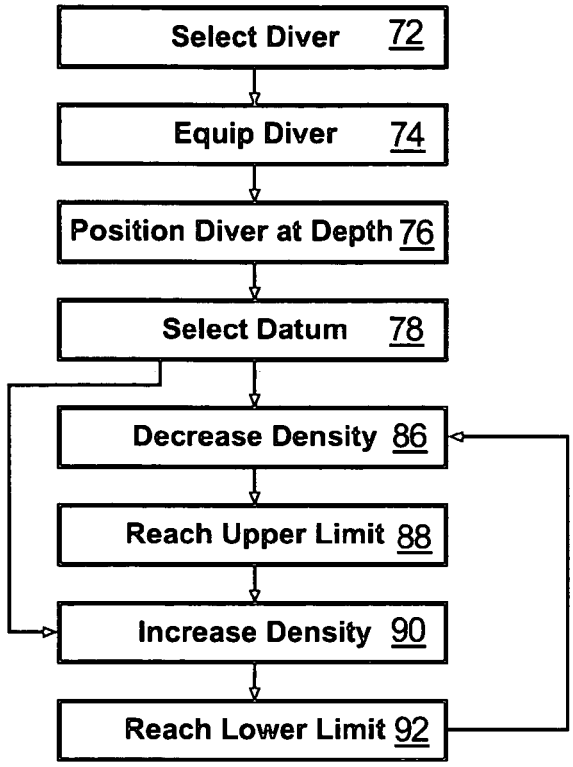
FIG. 14 is a schematic block diagram illustrating a process for generating horizontal movement using a hydrofoil and buoyancy compensator in accordance with the present invention.
Figure 15:
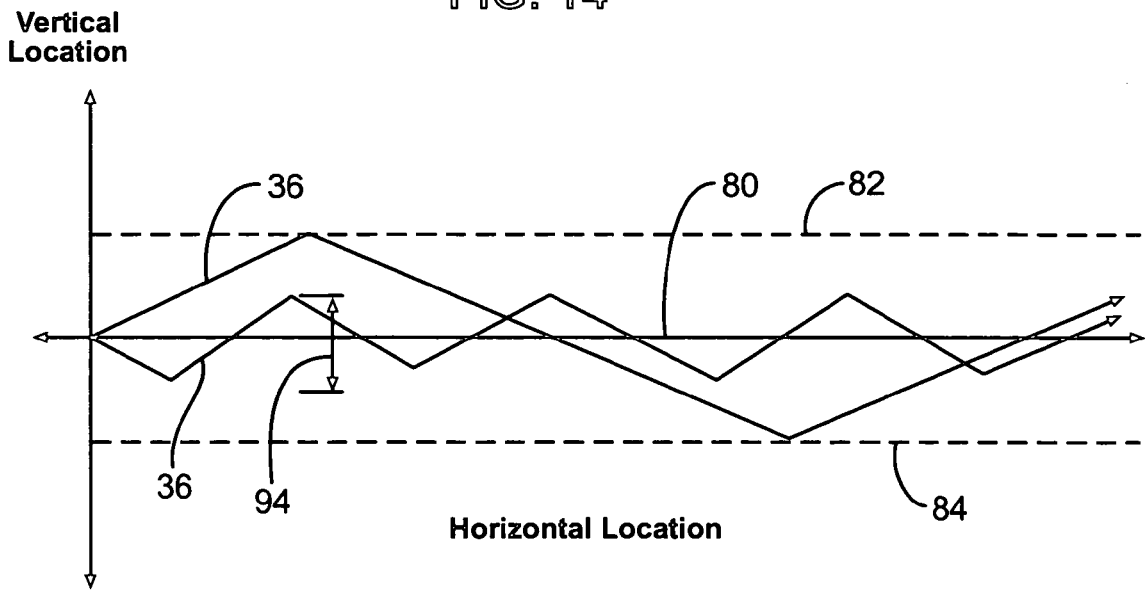
FIG. 15 is a graph plotting two propulsion trajectories in accordance with the present invention on axes representing a vertical location versus a corresponding horizontal location.

Referring to FIGS. 14 and 15, once a diver 38 is selected 72, he or she may be equipped 74 with a hydrofoil 10, buoyancy compensator 44, and other underwater equipment (e.g. diving mask, snorkel, tank of breathing air, regulator, wetsuit, fins, weight belt, etc.) as desired. The diver 38 may then position 76 herself at a desired depth. At depth, the diver 38 may select 78 a datum 80. A datum 80 may be a depth the diver 38 does not wish to exceed. Alternatively, a datum 80 may be a depth the diver 38 wishes to maintain within a selected deviation. For example, a datum 80 may be a depth of fifteen meters that the diver 38 desires to maintain, plus or minus three meters. In such an arrangement, the upper depth limit 82 selected by the diver 38 would be twelve meters and the lower depth limit 84 would be eighteen meters.

Upon selecting 78 the desired datum 80 and associated range in which the diver 38 desires to operate, the net density of the diver 38 and her equipment may be decreased 86 to a value less than the density of the surrounding water by selectively operating the buoyancy compensator 44. As a result, the diver 38 may begin to rise in the water. Before or after decreasing 86 the net density, the diver 38 may orient the hydrofoil 10 to a desired positive angle of attack 30*a*. Alternatively, the diver 38 may rely on non-uniform rising to automatically rotate the hydrofoil 10 to a positive angle of attack 30*a*, as discussed hereinabove.

Once the buoyant force 26 exceeds the weight force 22 and the hydrofoil 10 is positioned at a positive angle of attack 30*a*, the diver 38 will be propelled along a path 36 extending up 28 and forward. The diver 38 may then use her arms and legs 48 to maintain the hydrofoil 10 at the desired positive angle of attack 30*a*. If the positive angle of attack 30*a* reaches ninety degrees, forward progress may cease and the diver 38 and hydrofoil 10 may simply rise. If the positive angle of attack 30*a* exceeds ninety degrees, the diver 38 and hydrofoil 10 may begin moving backward, in addition to moving up 28.

When the diver 38 reaches 88 the upper depth limit 82, the net density of the diver 38 and her equipment may be increased 90 to a value greater than the density of the surrounding water by selectively operating the buoyancy compensator 44. As a result, the diver 38 may begin to sink in the water. Similar to the ascent actions, before or after increasing 90 the net density, the diver 38 may orient the hydrofoil 10 to a desired negative angle of attack 30*b*. Alternative, the diver 38 may rely on non-uniform sinking to automatically rotate the hydrofoil 10 to a negative angle of attack 30*b*, as discussed hereinabove.

Once the weight force 22 exceeds the buoyant force 26 and the hydrofoil 10 is positioned at a negative angle of attack 30*b*, the diver 38 will be propelled along a path 36 extending down 24 and forward. The diver 38 may then use her arms and legs 48 to maintain the hydrofoil 10 at the desired negative angle of attack 30*b*. If the negative angle of attack 30 reaches ninety degrees, forward progress may cease and the diver 38 and hydrofoil 10 may simply sink. If the negative angle of attack 30*b* exceeds ninety degrees, the diver 38 and hydrofoil 10 may begin moving backward, in addition to moving down 24.

When the diver 38 reaches 92 the lower depth limit 84, the net density of the diver 38 and her equipment may again be decreased 86 to a value less than the density of the surrounding water by selectively operating the buoyancy compensator 44. Accordingly, the diver 38 and hydrofoil 10 may begin to rise and the cycle may be repeated. At any time in the cycle, if the diver 38 desires to stop all movement, the net density of the diver 38 and her equipment may again be increased 90 or decreased 86 to a value equal to the density of the surrounding water by selectively operating the buoyancy compensator 44.

It is not necessary that a diver 38 always begin underwater propulsion using a hydrofoil 10 by decreasing 86 the net density. It is just as feasible for underwater propulsion to begin when a diver 38 increases 90 the net density. Similarly, it is not necessary for a diver 38 to rise or sink all the way to an upper or lower depth limit 82, 84 before operating (automatically or manually) the buoyancy compensator 44 and forcing the net density to the other side of neutral buoyancy. By more frequently switching the net density about a value of neutral buoyancy, a diver 38 may follow a path 36 maintained within a smaller band 94 or range 94 of depths. However, the efficiency in terms of horizontal distance traveled per amount of air spent decreases as the frequency increases at which the net density is switched about neutral buoyancy.

Selection 78 of a datum 80 may be of most value to divers 38 breathing at depth. Such divers 38 must carefully monitor their maximum depth to ensure that sufficient air remains in their tank 32 to allow for the corresponding staged denitrification stops. That is, dive tables typically display denitrification depths and waiting periods based on the maximum depth achieved during a dive. Accordingly, by selecting a datum 80, a diver 38 may calculate how long she can travel using a hydrofoil 10 in accordance with the present invention and still have enough air in the tank 32 to accommodate the required denitrification stops.

Divers 38 (e.g. snorkelers) who are not breathing at depth may not be so concerned with depth. Accordingly, for such divers 38 the step of selecting 78 a datum 80 may be omitted. Similarly, the upper depth limit 82 and lower depth limit 84 may be altered according to the situation. For example, for snorkelers the upper depth limit 82 may be the surface of the water. The lower depth limit 84 may be the sea floor, lake bottom, etc. or the maximum depth the snorkeler can reach and return to the surface within one breath.

Figure 16:
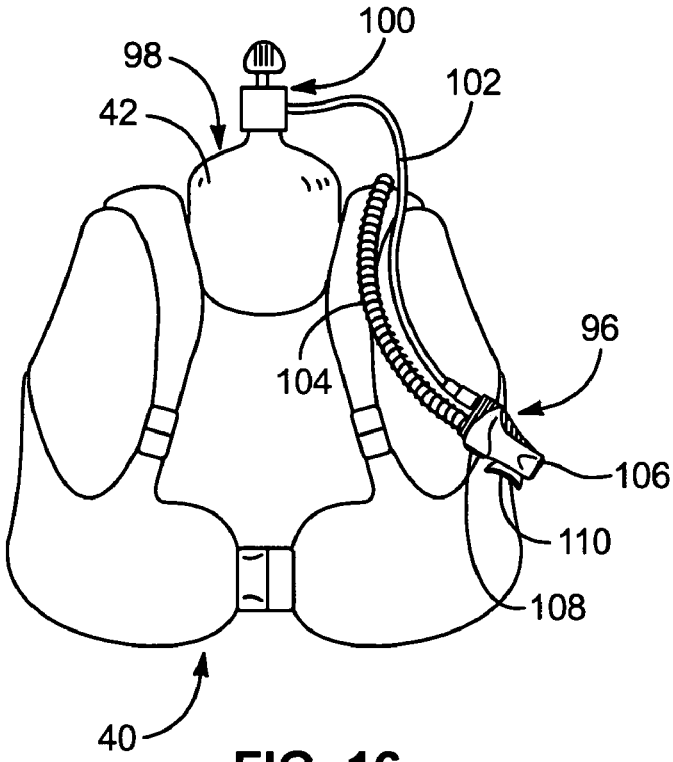
FIG. 16 is a perspective view illustrating one embodiment of a buoyancy compensator in accordance with the present invention.
Figure 17:
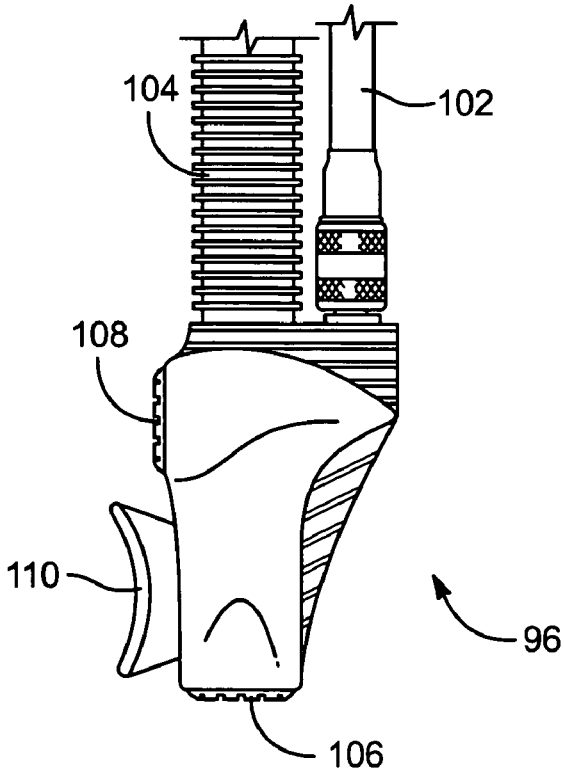
FIG. 17 is a side elevation view of one embodiment of a controller in accordance with the present invention.

Referring to FIGS. 16 and 17, in selected embodiments, a buoyancy compensator 44 in accordance with the present invention may include a controller 96 interposed between the source 98 of air and the expander. The controller 96 may allow a diver 38 to control the volume occupied or displaced by an expander. Underwater, control of the volume occupied by an expander may provide control over the net density of a diver 38 and her equipment 10, 40, 42, 44.

In certain embodiments in accordance with the present invention, a controller 96 may be an inflator 96. In general, laws require scuba divers to use vests 40 equipped with one or more inflatable bladders. Accordingly, all first stage regulators 100 are equipped with a port for supplying air to the such bladders. Typically, an inflator hose 102 extends from the first stage regulator 100, over the shoulder or under the arm of the diver 38, and down the torso 46 to engage the inflator 96. For ease of use and quick access, inflators 96 are generally located near the hip of a diver 38. In selected embodiments, a supply hose 104 may connect the inflatable bladders contained with the vest 40 to the inflator 96. Alternatively, an inflator 96 may secure directly to the vest 40 and the one or more bladders contained therewithin. In such embodiments, the supply hose 104 may be omitted.

Inflators 96 typically include two controls, actuators, or buttons 106, 108. A first button 106 (fill control 106) may control the passage of air from the inflator hose 102 into the one or more bladders contained within the vest 40. The second button 108 (vent control 108) may control the passage of air out of the one or more bladders. Accordingly, when a diver 38 desires to reduce her net density, she may press and hold the first (fill) button 106 until a desired net density is achieved or until the one or more bladders are filled to capacity. Similarly, when a diver 38 desires to increase her net density, she may press and hold the second (vent) button 106 until a desired net density is achieved or until the one or more bladders becomes empty. If desired, an inflator 96 may also include a crude mouthpiece 110 allowing a diver 38 to breath the air stored in the one or more bladders contained within the vest 40 during an emergency.

Figure 18:
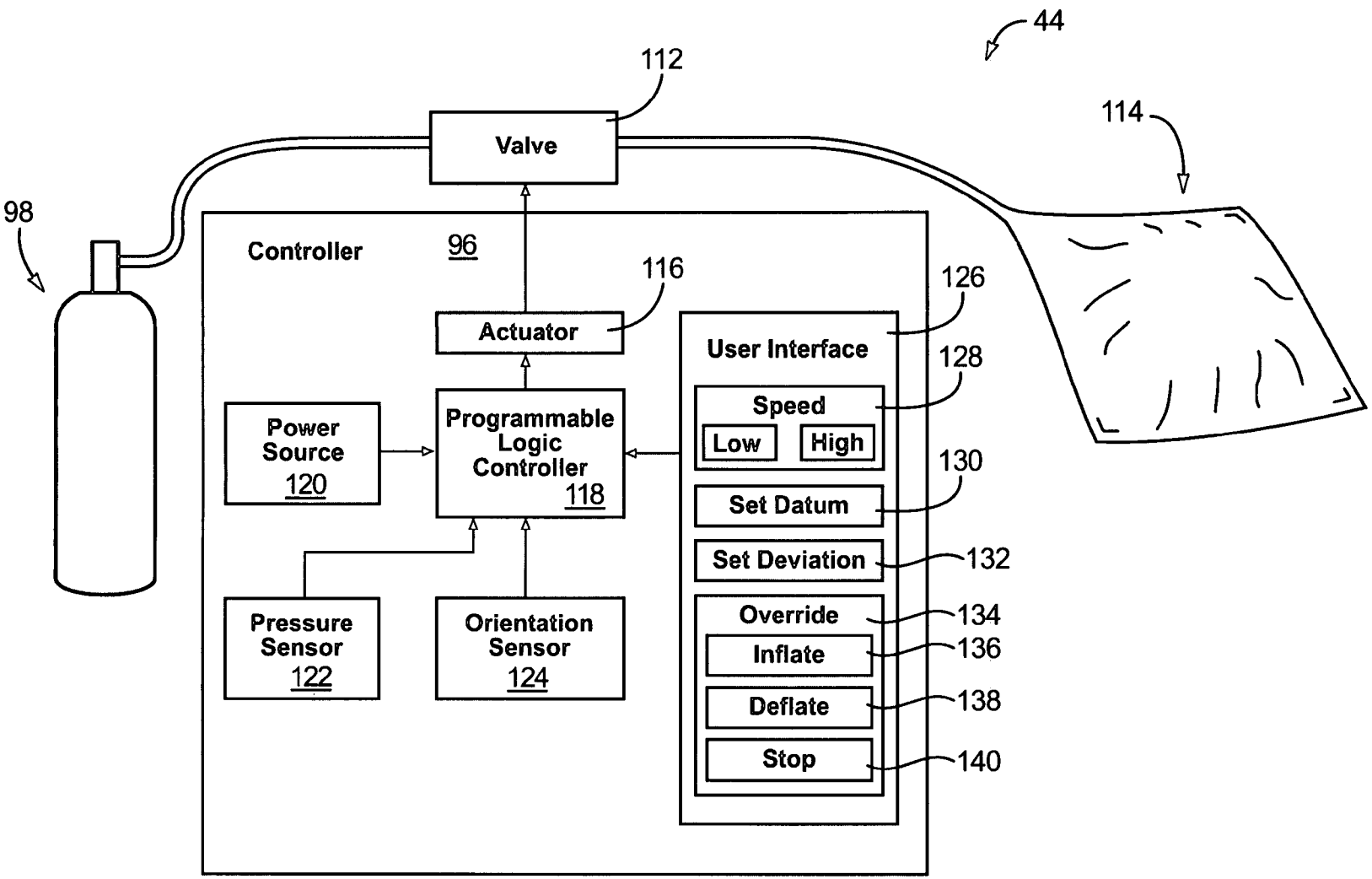
FIG. 18 is a schematic diagram of a buoyancy compensator comprising an automated controller in accordance with the present invention.

Referring to FIG. 18, in selected embodiments, a controller 96 in accordance with the present invention may be automated. For example, a valve 112 may be interposed between a source 98 of air and the expander 114 (e.g. inflatable bladder 114). Under the direction of a controller 96, the valve 112 may pass air from the source 98 to the expander 114, stop air from entering or leaving the expander 114, or may permit the air within the expander 114 to escape into the surrounding environment.

An automated controller 96 may include an actuator 116 (e.g. solenoid) acting under the direction of a programmable logic controller 118 (PLC). The PLC 118 may receive power from a power source 120 (e.g. battery). The PLC 118 may receive data inputs from an array of sensors as needed or desired. For example, a pressure sensor 122 may provide depth information to the PLC 118. An orientation sensor 124 may provide information regarding the orientation of the hydrofoil 10.

A PLC 118 may be programmed with a variety of instructions. For example, the PLC 118 may be programmed to let air into or out of an expander 114 only when the hydrofoil 10 is oriented with the wings span 54 extending substantially in the horizontal direction 32. Similarly, the PLC 118 may be programmed not to left air in or out of a volume control 114 when the hydrofoil 10 is positioned at too large a positive or negative angle of attack 30*a*, 30*b*. This may restrain the controller 96 from effectively launching the diver 38 to the surface or dropping her to the bottom when the hydrofoil 10 is not properly positioned to contain the vertical motion and convert the vertical forces (weight force 22, buoyant forces 26) into motion in the horizontal direction 32. Sensors may attach to the hydrofoil 10 to determine whether a direction or speed is appropriate. Such feedback can be used by the PLC to regulate or control the buoyancy compensation.

Additionally, a PLC 118 may be programmed to stop vertical motion if changes in pressure, as measured by the pressure sensor 122, exceed selected limits of change rates, or values within selected periods of time. Vertical motion may be stopped by operating the valve 112 to let air in or out of the expander 114 until changes in pressure over time are substantially zero. Such a safeguard may prevent a diver 38 from inadvertently ascending too rapidly without the necessary denitrification stops.

A user interface 126 may provide a diver 38 with control over various aspects of the PLC 118. For example, a user interface 126 may include a speed selector 128. In selected embodiments, a speed selector 128 may allow a diver 38 to choice between "high" and "low." When "low" is selected, the PLC 118 may limit the amount of air passing in or out of the expander 114 to limit the amount by which the weight force 22 is ever permitted to exceed the buoyant force 26 and the amount the buoyant force 26 is ever permitted to exceed the weight force 22. By limiting such force imbalances, speeds, whether up 28, down 24, horizontally 32, or some combination thereof, may be limited.

Alternatively, when "high" is selected, the PLC 118 may maximize the amount of air passing in or out of the expander 114. This may produce the maximum imbalance between the weight force 22 and the buoyant force 26. The maximum imbalance may maximize the speed of the diver 38 whether traveling up 28, down 24, horizontally 32, or some combination thereof.

A user interface 126 may also include a datum selector 130. A datum selector 130 may allow a diver 38 to select a datum 80 above which, below which, or about which she wishes to operate. A user interface 126 may also include a deviation selector 132 permitting a diver 38 to select how far she wishes to deviate from the datum 80. Once selected, the datum 80 and deviation may combine to form an upper depth limit 82 and a lower depth limit 84. Accordingly, the PLC 118 controls injection of air into expander 114 when the pressure sensor 122 informs it that it is at the lower depth limit 84. Similarly, the PLC 118 may, likewise, dump air from the expander 114 when the pressure sensor 122 informs it that it is at the upper depth limit 82.

In certain embodiments, a user interface 126 may include an override 134. In selected situations, it may be desirable for a diver 38 impose manual control over the function of a controller 96. For example, it situations where a diver 38 desires to travel along an irregular underwater formation, she may prefer manual control rather than an autopilot experience that may be provided by an automated controller 96.

An override 134 in accordance with the present invention may include inflate 136, deflate 138, and stop 140 commands. When the inflate command 136 is selected, the PLC 118 may override all other programming and manipulate the valve 112 to allow air to pass from the source 98 to the expander 114. When the deflate command 138 is selected, the PLC 118 may override all other programming and manipulate the valve 112 to allow air to exit the expander 114. When the stop command 140 is selected, the PLC 118 may override all other programming and implement a routine operating the valve 112 to let air in or out of the expander 114 until changes in pressure over time are substantially zero.

Figure 19:
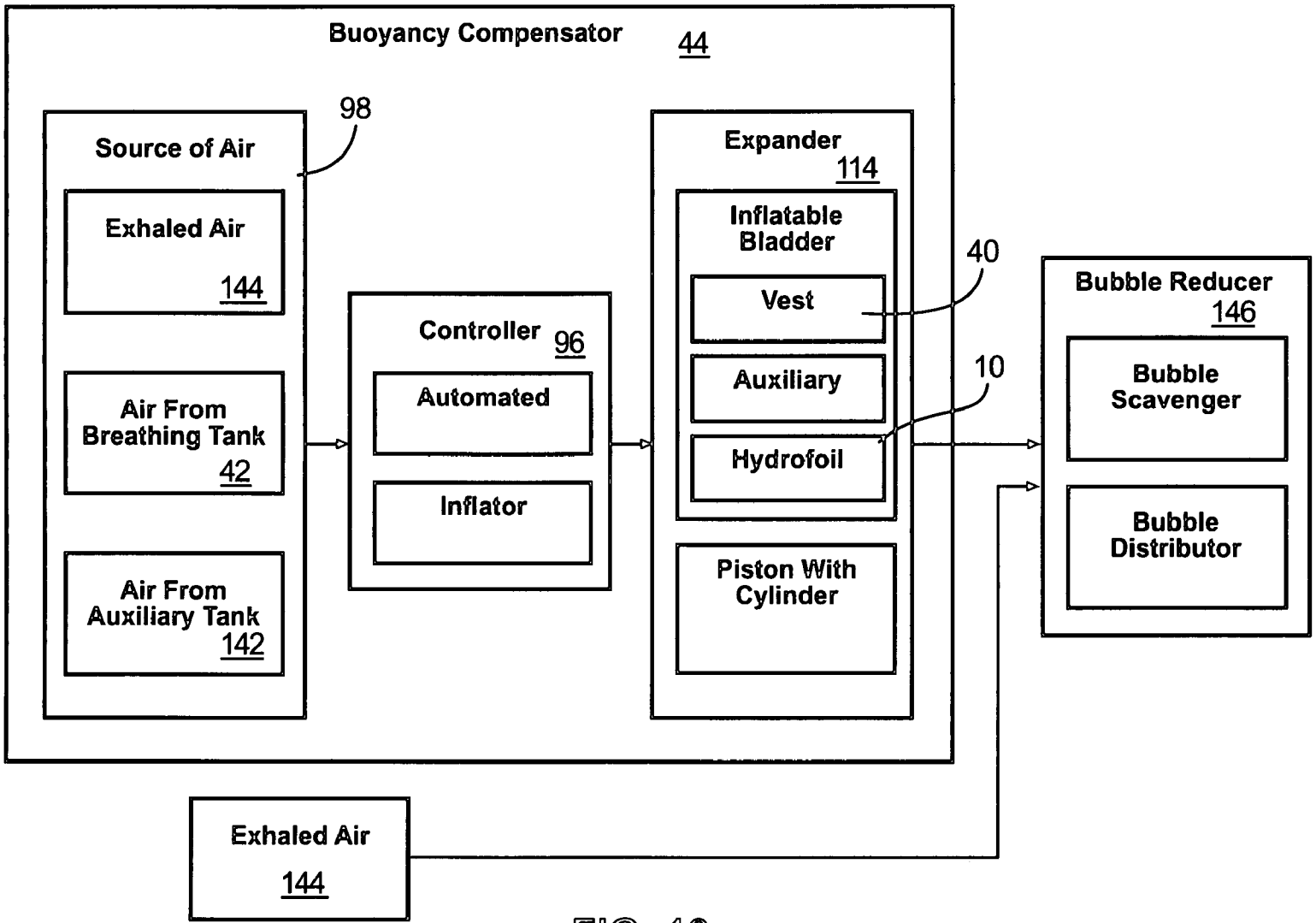
FIG. 19 is a schematic block diagram illustrating various possible embodiments of a buoyancy compensator and their interaction with a bubble reducer in accordance with the present invention.

Referring to FIG. 19, a buoyancy compensator 44 in accordance with the present invention may operate using any combination of suitable sources 98 of air, controllers 96, and expanders 114. The basic idea is that by increasing or decreasing the volume occupied by a diver 38 and her equipment 10, 40, 42 without changing the mass thereof, the net density may be correspondingly decreased or increased. Accordingly, any combination capable of producing such an effect may be considered a buoyancy compensator 44.

As stated hereinabove, suitable sources 98 of air for a buoyancy compensator 44 may include a tank 42 containing breathing air, an auxiliary tank 142 of air, or some combination thereof. Additionally, exhaled air 144 may be suitable for use in a buoyancy compensator 44.

When a diver 38 breathes underwater, the first stage regulator 100 and a second stage regulator combine to provide air to the diver 38 at a pressure equal to the pressure of the surrounding water. It then follows that exhaled air 144 is at the same pressure as the surrounding water. As a result, with a minimal increase in effort by a diver 38, exhaled air 144 may be used to fill an expander 114 such as an inflatable bladder 114.

As discussed hereinabove, a controller 96 in accordance with the present invention may be an automated controller 96 or an inflator 96. However, any other mechanism permitting a diver 38 to selectively pass air from the source 98 to the expander 114, stop air from entering or leaving the expander 114, or permit the air within the expander 114 to escape into the surrounding environment may be suitable for a controller 96.

As discussed hereinabove, an expander 114 may be a device such as one or more inflatable bladders 114. Such bladders 114 may be positioned in any suitable location. Suitable locations may include within a vest 40, withing a cavity formed inside a hydrofoil 10, within some other auxiliary volume, and the like. Alternatively, an expander 114 may be a cylinder and piston or flexible separator arrangement 114 where air applied to one side of the piston or separator causes the piston to move and expel water from the other side. In general, an expander 114 may be any device capable of using a volume of air to displace a volume of water wherein the volume of water may return once the volume of air is released.

In certain applications, it may be desirable to limit the amount, visibility, or sound of the bubbles produced when using a hydrofoil 10 in accordance with the present invention. Accordingly, selected embodiments in accordance with the present invention may include a bubble reducer 146. In certain embodiments, a bubble reducer 146 may comprise a bubble scavenger 146 containing selected compounds that react with molecules contained within the air before it is released from the expander 114. By reacting out selected gases, the overall volume of gas in the air released may be reduced.

Alternatively, a bubble reducer 146 may comprise a bubble distributor 146. A bubble distributor 146 may limit the ability of bubbles to agglomerate. This may be accomplished by diffusing the release of bubbles from the expander 114 across an array of orifices. For example, in selected embodiments, an expander 114 may exhaust air into a cavity within a hydrofoil 10. The air may escape the hydrofoil 10 through an array of orifices extending across the wing span 54. Accordingly, the air may have more distance to travel horizontally to agglomerate and thus travel the distance to the surface as many small bubbles spread over a selected area.

If desired, a bubble reducer 146 may comprise both a bubble scavenger reacting out as much of the air as possible and a bubble distributor to parcel and distribute the residual. Additionally, a bubble reducer 146 in accordance with the present invention may service exhaled air 144 directly from a diver 38, regardless of whether it was used by a buoyancy compensator 44.

Figure 20:
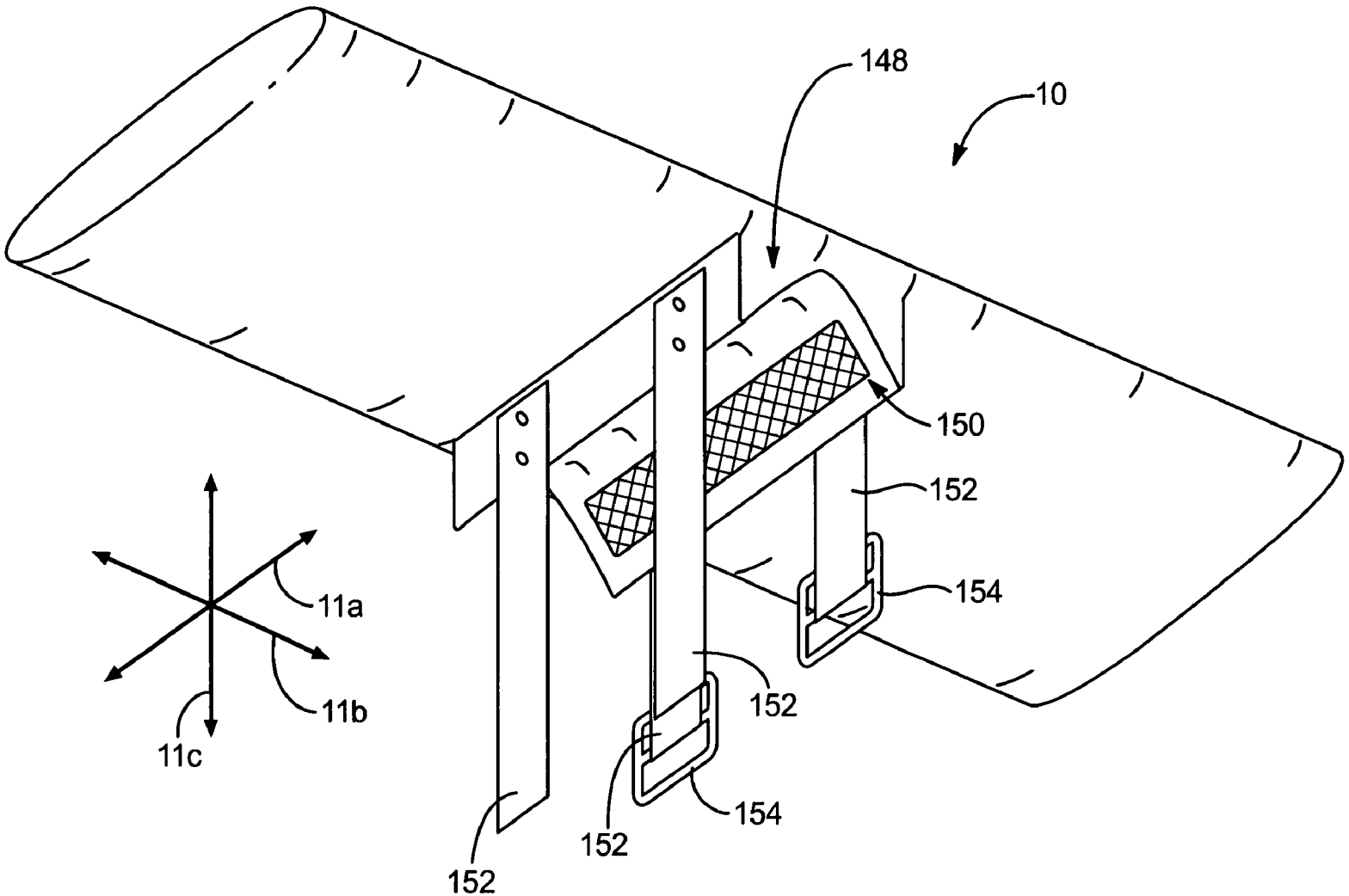
FIG. 20 is a perspective view of one embodiment of a rectangularly shaped hydrofoil with a cradle in accordance with the present invention to facilitate securement thereof to a tank.

Referring to FIG. 20, a hydrofoil 10 in accordance with the present invention may be connected to a diver 38 in any suitable manner. For example, in selected embodiments, a hydrofoil 10 may secure to a tank 42 of breathing air. The tank 42, in turn, may be secured to the diver 38 by a vest 40.

To facilitate securement to a tank 42, a hydrofoil 10 may include a cradle 148. The cradle 148 may have a shape selected to correspond to the shape of the tank 42. In selected embodiments, a cradle 148 may be formed as a channel shaped like a "V." In other embodiments, the cradle 148 may be formed as a curved channel substantially matching the curvature of the tank 42. If desired, resilient (e.g. rubberized) pads 150 or the like may be affixed at the locations where the cradle 148 contacts the tank 42. The pads 150 may resist sliding of the hydrofoil 10 with respect to the tank 42.

In selected embodiments, one or more straps 152 and fasteners 154 or the like may be used to maintain the cradle 148 firmly in contact with the tank 42. For example, in one embodiment, straps 152 and buckles 154 may be used. In another embodiment, resiliently stretchable straps 152 and hook and loop type fasteners 154 may be used.

Figure 21:
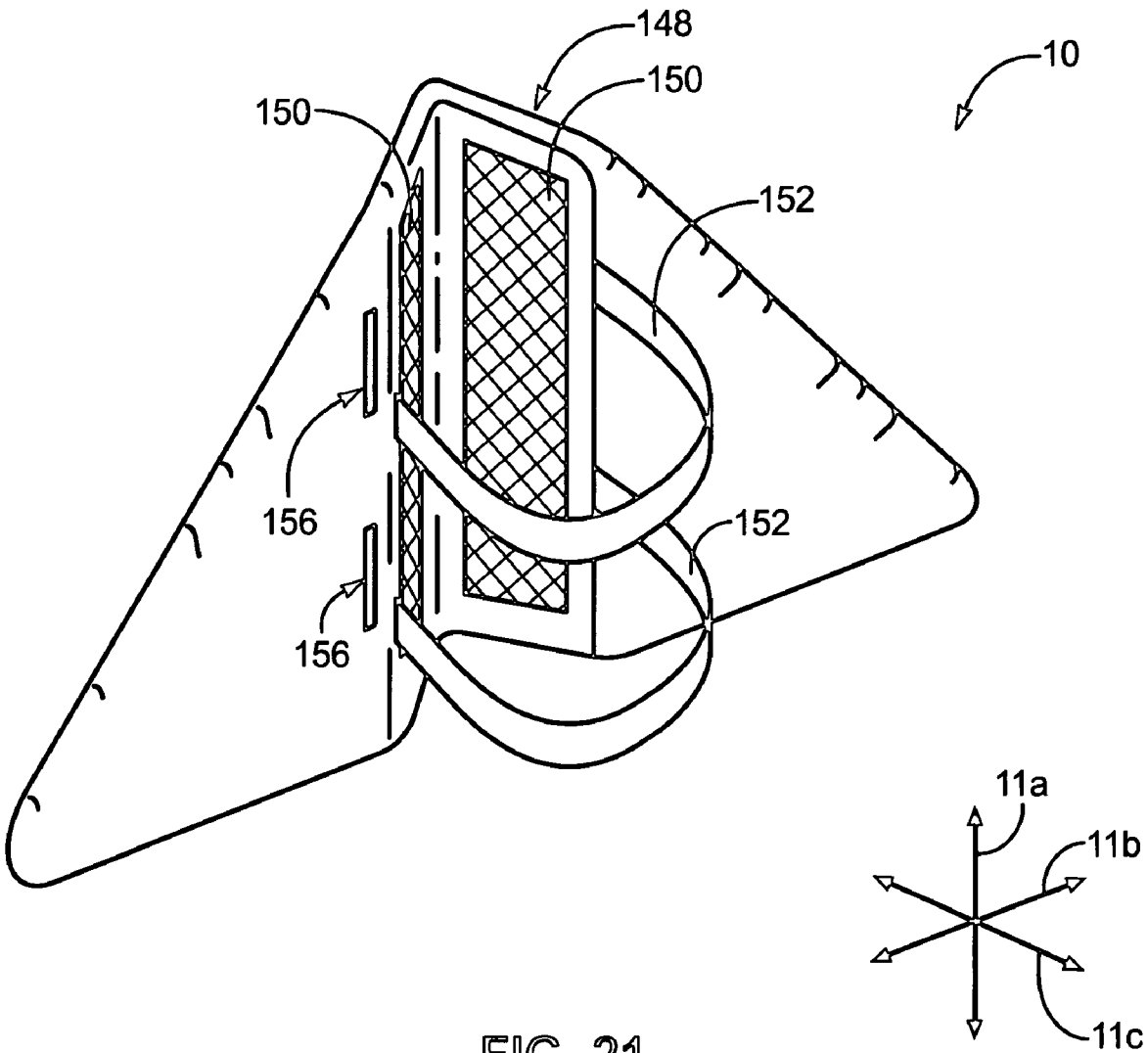
FIG. 21 is a perspective view of one embodiment of a delta or triangularly shaped hydrofoil with an alternative embodiment of a cradle in accordance with the present invention to facilitate securement thereof to a tank.

Referring to FIG. 21, in selected embodiments, a hydrofoil 10 may be arranged to facilitate securement. For example, one or more straps 152 or bands 152 may secure to one side of a cradle 148. Once a tank 42 is secured to a vest 40, the hydrofoil 10 may be applied to the tank 42 and the free ends of the one or more straps 152 may be passed therearound and inserted through corresponding apertures 156 in the hydrofoil 10. The apertures 156 may each include a selectively releasable latch, ratchet, or the like. Accordingly, the one or more straps 152 may be pulled tight by the diver 38 and held by the ratchet. When a diver 38 desires to remove the hydrofoil 10 from the tank 42, each catch or ratchet may be released and the corresponding strap 152 removed.

Figure 22:
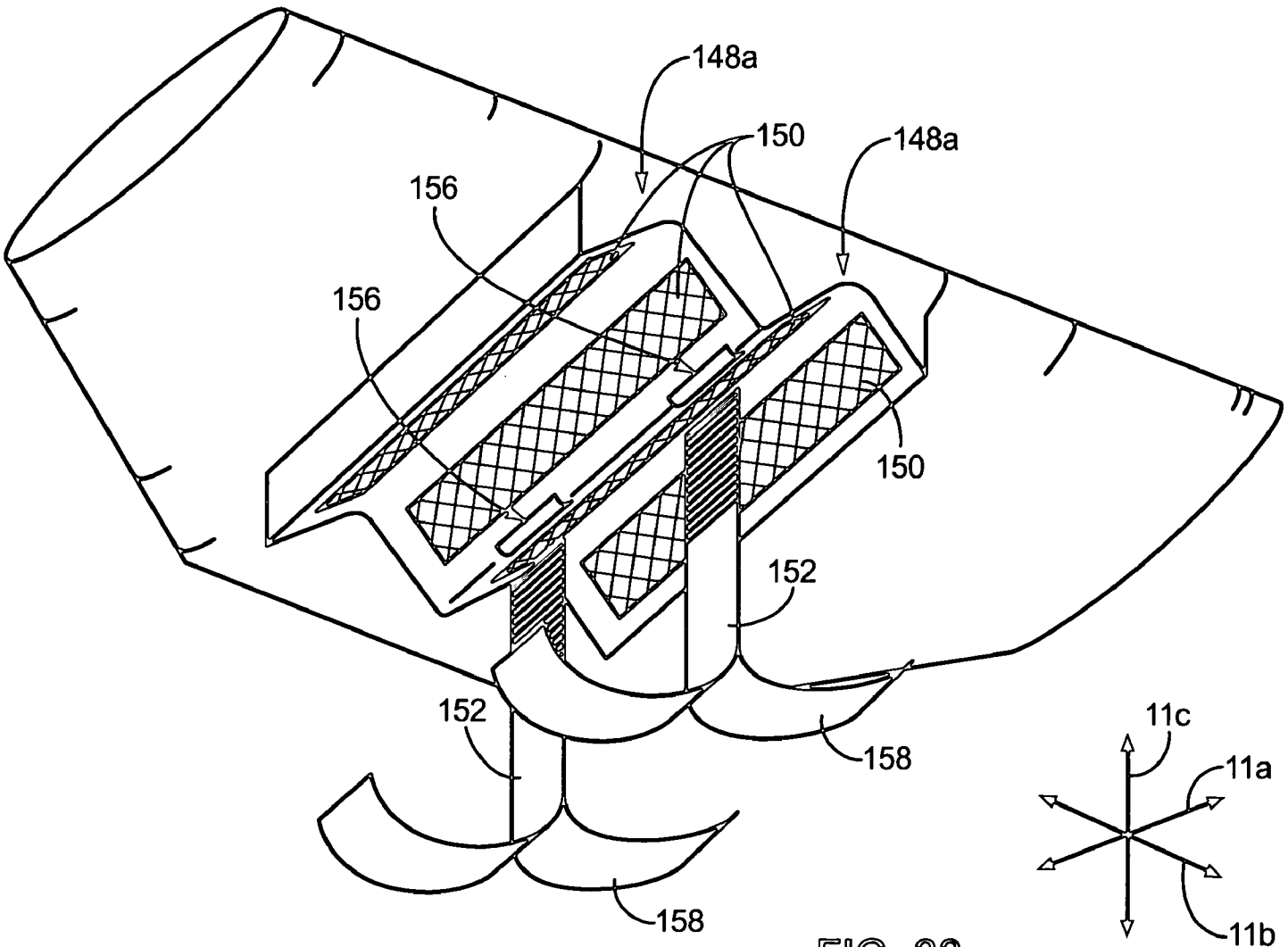
FIG. 22 is a perspective view of one embodiment of a tapered hydrofoil with dual cradles in accordance with the present invention to facilitate securement thereof to a two-tank arrangement.

Referring to FIG. 22, in selected situations, a diver 38 may employ two tanks 42 containing breathing air. In two-tank arrangements, the tanks 42 are typically oriented in parallel and secured to a vest 40. A hydrofoil 10 in accordance with the present invention may be applied to a two-tank arrangement. For example, a hydrofoil 10 may include first and second cradles 148*a*, 148*b*. Each cradle 148*a*, 148*b* may engage a different tank 42.

A hydrofoil 10 equipped to engage two tanks 42 may be secured to those tanks 42 in any suitable manner. In selected embodiments, one or more brackets 158 may be slipped behind the tanks 42 once secured to a vest 40. Straps 152 extending from the brackets 158 may pass through apertures 156 in the hydrofoil 10. The apertures 156 may each include a selectively releasable ratchet or other catch. Accordingly, the straps 152 may be pulled tight by the diver 38 and held by the ratchet. When a diver 38 desires to remove the hydrofoil 10 from the tanks 42, each ratchet may be released and the corresponding strap 152 removed.

Figure 23:
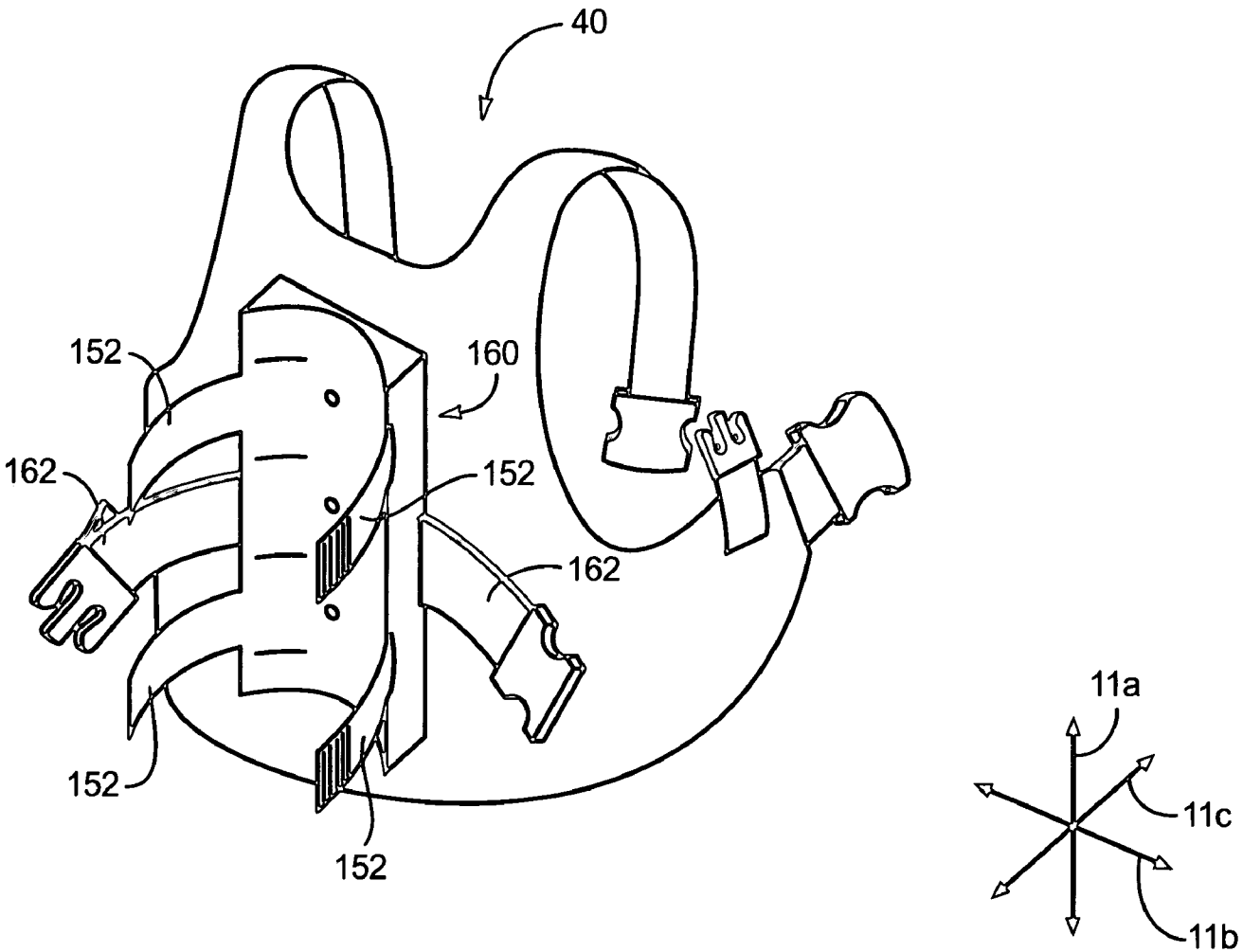
FIG. 23 is a perspective view of one embodiment of a vest having a cradle with straps extending therefrom to facilitate securement of a hydrofoil thereto in accordance with the present invention.

Referring to FIG. 23, in selected embodiments, a vest 40 may include a cradle 160 to facilitate securement of a tank 32. Similar to a cradle 148 incorporated into a hydrofoil 10, a cradle 160 incorporated into a vest 40 may be formed as a curved channel or a channel shaped like a "V."

In certain embodiments, a cradle 160 incorporated into a vest 40 may facilitate securement of a hydrofoil 10. For example, a cradle 160 may have one or more straps 152 extending therefrom. In some embodiments, the straps 152 may be homogeneously formed with the rest of the cradle 160. Alternatively, the straps 152 may be fastened, using snaps, rivets, bolts, or the like, to the rest of the cradle 160.

A hydrofoil 10 may be applied to the cradle 160 after the tank 42 is secured therein by a tank strap 162. Alternatively, the engagement between the hydrofoil 10 and the cradle 160 may be sufficient to securely hold a tank 42 therebetween. To secure the hydrofoil 10 to the cradle 160, the free ends of the one or more straps 152 may be inserted through corresponding apertures 156 in the hydrofoil 10. The apertures 156 may each include a selectively releasable ratchet. Accordingly, the one or more straps 152 may be pulled tight and held by the ratchet. When a diver 38 desires to remove the hydrofoil 10 from the tank 42, each ratchet may be released and the corresponding strap 152 removed.

Figure 24:
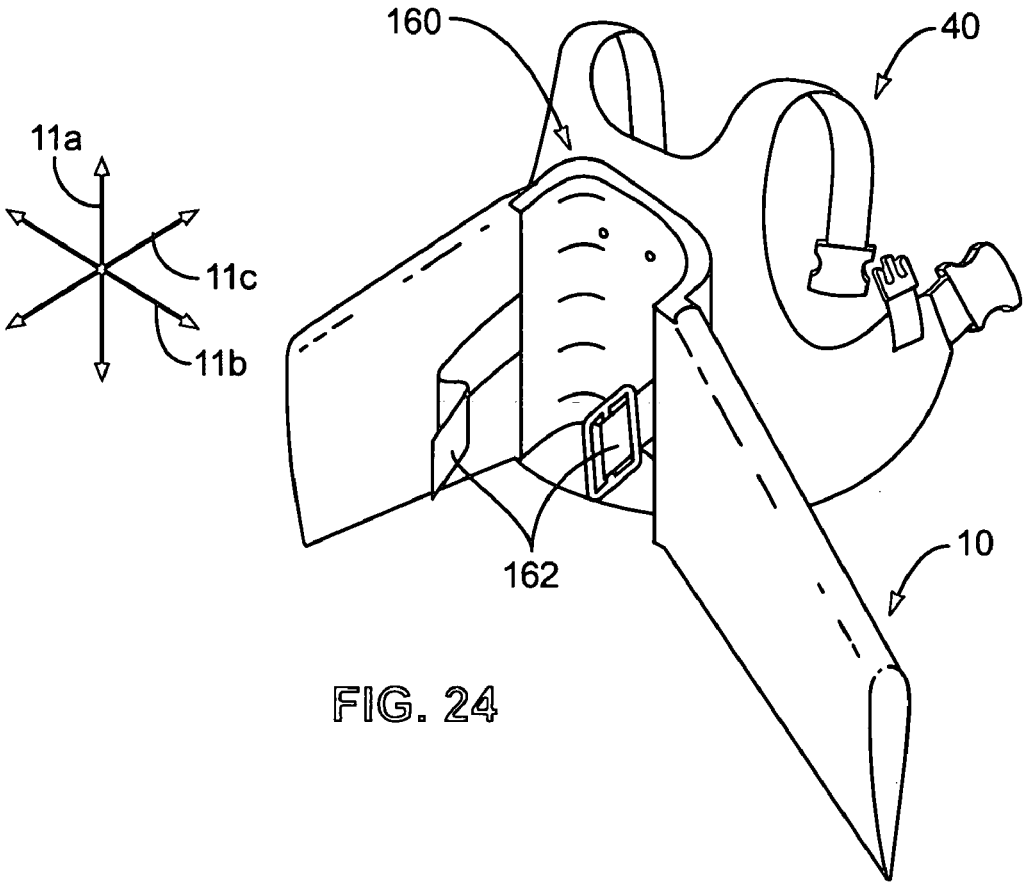
FIG. 24 is a perspective view of one embodiment of a swept-back hydrofoil combined with a tank cradle and vest in accordance with the present invention.

Referring to FIG. 24, in selected embodiments, a hydrofoil 10 in accordance with the present invention may be secured directly to a vest 40. For example, in certain embodiments, a hydrofoil 10 may be homogeneously formed as part of a cradle 160. In one embodiment, the cradle 160 and hydrofoil 10 may be molded as a single piece from a polymer. Alternatively, a hydrofoil 10 may be glued, welded, bolted, screwed, or otherwise fastened directly to a cradle 160.

Figure 25:
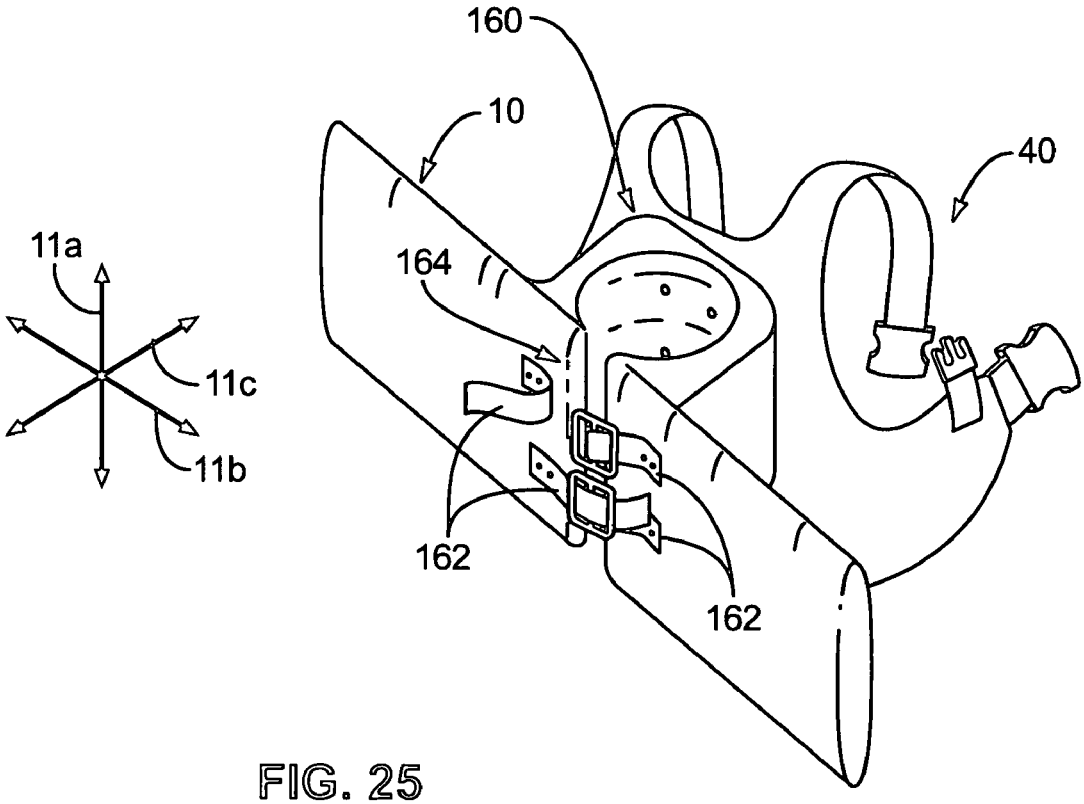
FIG. 25 is a perspective view of one embodiment of a rectangularly shaped hydrofoil combined with a hoop clamp, tank cradle and vest in accordance with the present invention.

Weights may be secured to, or insert molded with, a cradle 160 and hydrofoil 10 as desired or needed to compensate for the density of the materials used in their formation. If desired, one or more tank straps 162 may be employed to secure a tank 42 within the cradle 160. The tank strap 162 pulled tightly over a tank 42 may increase the stiffness of the hydrofoil 10 about an axis extending in the longitudinal direction 11*a*. While illustrated in a single cradle 160 embodiment, a two-cradle 160 embodiment accommodating two tanks 42 is also within the scope of the present invention Referring to FIG. 25, in selected embodiments, a hydrofoil 10 and cradle 160 may combine to form a hoop clamp for encircling and securing a tank 42. A slot 164 formed in the hydrofoil 10 may provide the flexibility allowing the combination 10, 160 to squeeze tightly against the tank 42. One or more tanks straps 162 or other locking devices may be used to generate and maintain the clamping force holding the tank 42 firmly in place.

Figure 26:
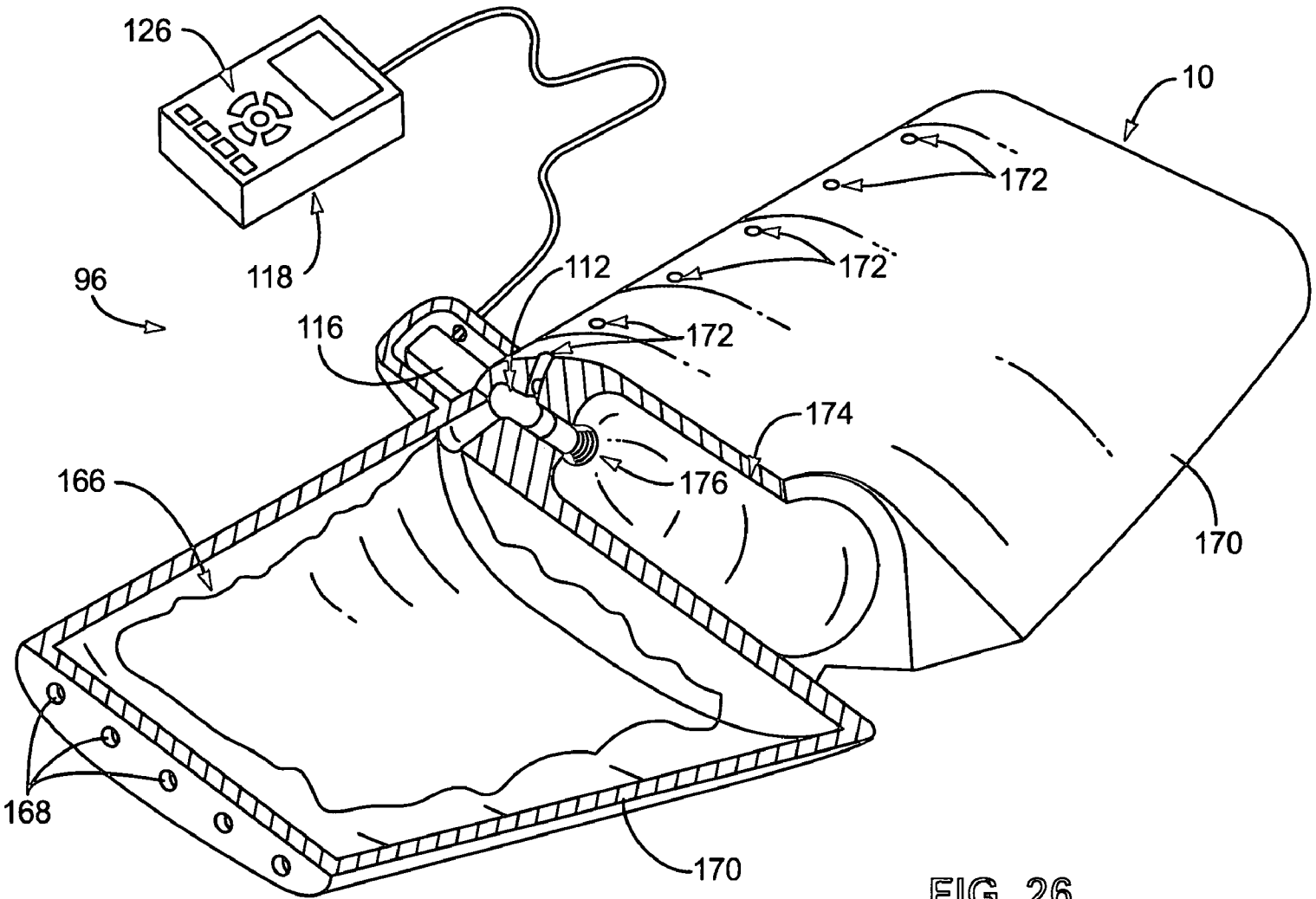
FIG. 26 is a partially cut-away, perspective view of one embodiment of a buoyancy compensator integrated with a hydrofoil in accordance with the present invention.

Referring to FIG. 26, as stated hereinabove, a cavity 166 within a hydrofoil 10 may be utilized by a buoyancy compensator 44 in accordance with the present invention. For example, one or more expanders 114 (e.g. inflatable bladders 114) may be placed within such a cavity 166. Under the direction of a controller 96, air may be inserted into or dumped (vented) from the expander 114. Apertures 168 may provide fluid communication between the cavity 166 and the surrounding environment. Accordingly, water may enter or exit the cavity 166 through the apertures 168 as needed to accommodate the changes in volume of the expander 114.

For example, as air enters and expands an inflatable bladder 144 water may be forced out of the cavity 166 through the apertures 168, thereby decreasing the net density of the hydrofoil 10. Alternatively, as air is dumped from the inflatable bladder 114 water may be enter the cavity 166 through the apertures 168 to fill the available volume. Accordingly, the net density of the hydrofoil 10 may be increased.

In selected embodiments, the apertures 168 providing fluid communication between the cavity 166 and the surrounding environment may be positioned to assist in forward propulsion. For example, in some embodiments, the apertures 168 may be aligned along the trailing edge 170 of the hydrofoil 10. Ejecting the water from the cavity 166 out the trailing edge 170 may generate an "equal and opposite" force urging the hydrofoil 10 forward.

When air is dumped from an expander 114 in accordance with the present invention, it may pass though an outlet 172 in the hydrofoil 10 to reach the surrounding environment. The pressure of the surrounding water acting on the expander 114 may provide the impetus to urge the air out. If desired, dumped air may be directed to an array of outlets 172. An array of outlets 172 may function as a bubble reducer 146.

Air may be passed to an expander 114 contained within a hydrofoil 10 in any suitable manner. For example, in selected embodiments, air may be passed to the expander 114 through a hose extending from a tank 42 secured elsewhere (e.g. the back of a diver 38). Alternatively, a tank may secure directly to a hydrofoil 10. In one embodiment, a hydrofoil 10 may be formed with a cavity 174 sized to receive a tank therein. One end of the cavity 174 may include a threaded engagement 176 to secure the tank and tap. the air contained therein.

Figure 27:
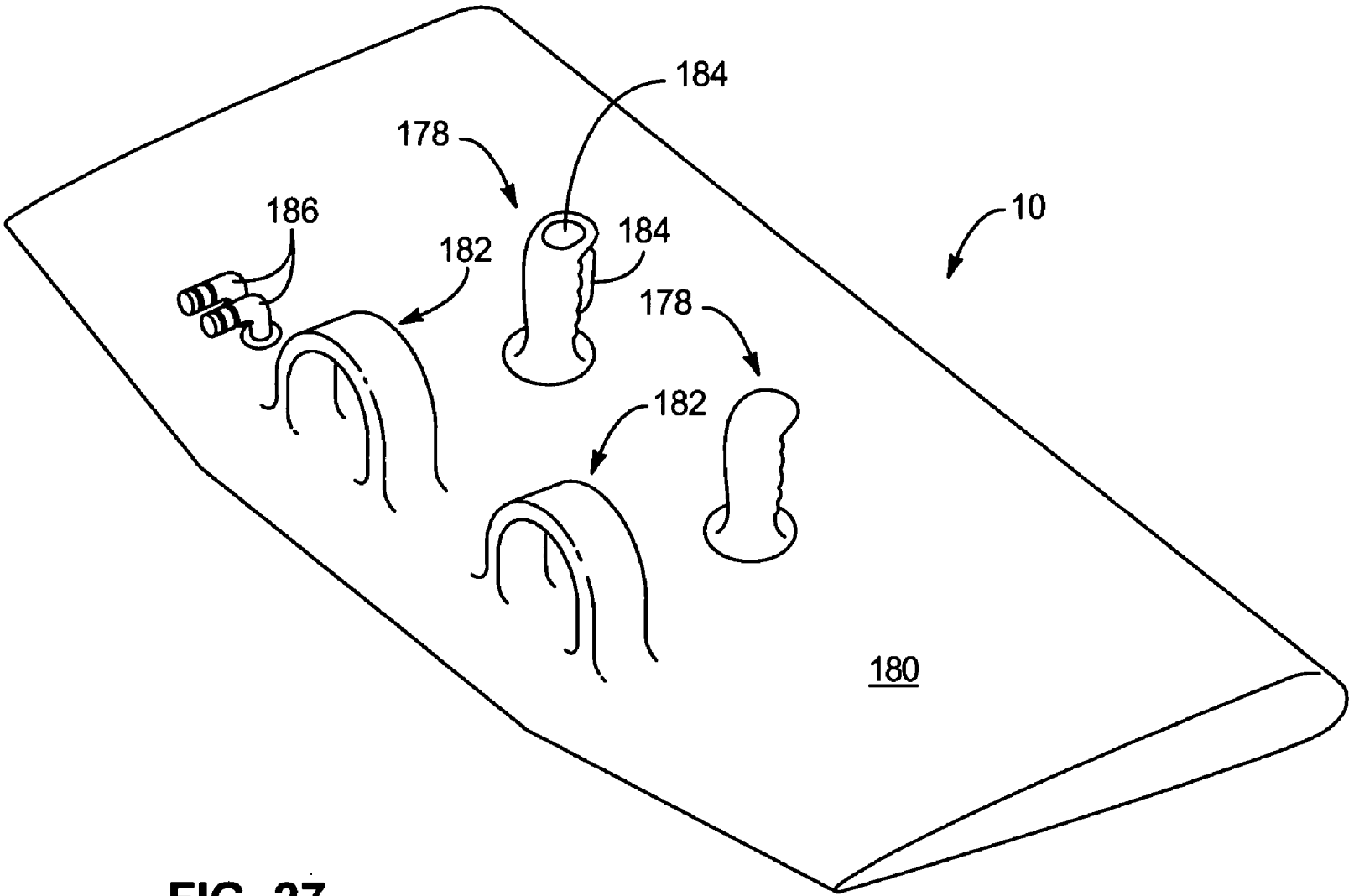
FIG. 27 is a perspective view of one embodiment of a hand-held hydrofoil in accordance with the present invention.

Referring to FIG. 27, in selected embodiments, a hydrofoil 10 in accordance with the present invention may be held by a diver 38. For example, handles 178 may extend from an upper surface 180 of the hydrofoil 10. If desired, stabilizers 182 through which the forearms of diver 38 extend may provide additional control over the positioning and attitude of the hydrofoil 10.

If desired, one or both of the handles 178 may include buttons 184. Similar to the buttons 106, 108 on an inflator 96, such buttons 184 may control the injection and dumping of air from an expander 114. Accordingly, hose adapters 186 as needed may assist in securing hoses (e.g. inflator hose 102, supply hose 104, etc.) to transfer air to and from a valve 112 operating in association with the buttons 184. Alternatively, in selected embodiments, a hand held hydrofoil 10 may include an internal buoyancy compensator as described with respect to FIG. 26. In such an embodiments, the buttons 184 on the handles 178 may control the travel of air without the need for hoses extending external to the hydrofoil 10.

The present invention may be embodied in other specific forms without departing from its basic functions or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of underwater propulsion comprising:

equipping a user with a buoyancy compensator comprising a controller, tank containing at least one gas, and an expander, the tank being operably connected and pressurized to deliver the at least one gas to the expander under the control of the controller;

providing a hydrofoil;

connecting the hydrofoil to the user;

positioning the user and hydrofoil underwater at a selected depth;

programming into the controller data effectively defining a maximum depth and a minimum depth; and cycling, by the controller, the overall buoyancy of the user and hydrofoil between levels below and above neutral buoyancy to automatically and alternately propel the user to the maximum and minimum depths, respectively.

2. The method of claim 1, wherein the hydrofoil defines longitudinal, lateral and transverse directions substantially orthogonal to one another and has a span extending in the lateral direction.

3. The method of claim 2, wherein the hydrofoil is streamlined with respect to flow in the longitudinal direction.

4. The method of claim 3, wherein positioning the user and hydrofoil underwater further comprises orienting the hydrofoil such that the lateral direction extends substantially horizontally.

5. The method of claim 4, further comprising orienting the hydrofoil at a negative angle of attack when the overall buoyancy of the user and hydrofoil is below neutral buoyancy.

6. The method of claim 5, further comprising orienting the hydrofoil at a positive angle of attack when the overall buoyancy of the user and hydrofoil is above neutral buoyancy.

7. The method of claim 6, wherein the expander comprises a vest, worn by the user, containing one or more inflatable bladders.

8. The method of claim 7, wherein the vest further comprises a tank cradle securing the tank substantially parallel to and adjacent the spinal column of a user.

9. The method of claim 8, wherein connecting the hydrofoil to the user comprises connecting the hydrofoil to the vest.

10. The method of claim 9, wherein connecting the hydrofoil to the vest comprises securing the hydrofoil to the tank.

11. The method of claim 9, wherein the user is a scuba diver.

12. The method of claim 9, wherein connecting the hydrofoil to the vest comprises connecting the hydrofoil to the tank cradle.

13. The method of claim 12, wherein connecting the hydrofoil to the tank cradle further comprises homogeneously forming the hydrofoil as part of the tank cradle.

14. A method of underwater propulsion comprising:

providing a hydrofoil defining longitudinal, lateral, and transverse directions substantially orthogonal to one another, the hydrofoil having a span in the lateral direction and a substantially streamlined shape with respect to flow in the longitudinal direction;

providing a buoyancy compensator comprising a controller automatically adjusting the buoyant force produced by the buoyancy compensator;

connecting the hydrofoil to a user;

programming into the controller data effectively defining a maximum depth and a minimum depth;

positioning the hydrofoil underwater such that the lateral direction extends substantially horizontally; and controlling, by the controller, the overall buoyancy of the user and hydrofoil to continuously, automatically, and alternately propel the user to the maximium and minimum depths.

15. The method of claim 14, further comprising orienting the hydrofoil at a negative angle of attack when the overall buoyancy of the user and hydrofoil is below neutral buoyancy.

16. The method of claim 15, further comprising orienting the hydrofoil at a positive angle of attack when the overall buoyancy of the user and hydrofoil is above neutral buoyancy.

17. The method of claim 16, wherein the buoyancy compensator comprises at least one bladder contained within the hydrofoil.

18. The method of claim 16, wherein:

the buoyancy compensator further comprises a vest, worn by a user, containing one or more inflatable bladders; and the controller comprises a processor, actuator, pressure sensor, and valve, the processor programmed to cause the actuator to manipulate the valve in accordance with data reported by the pressure sensor to the processor.

19. The method of claim 18, wherein alternating the overall buoyancy of the user and hydrofoil between levels above and below neutral buoyancy comprises correspondingly charging and discharging at least one gas from the one or more inflatable bladders.

20. A method of underwater propulsion comprising:

equipping a scuba diver with a regulator, vest containing one or more inflatable bladders, inflator, and tank containing at least one gas, the tank delivering the at least one gas to the one or more inflatable bladders under the control of the inflator and to the regulator;

providing a hydrofoil having a wing area of at least two square feet;

providing a controller operating on the inflator to automatically adjust the buoyant force produced by the vest;

connecting the hydrofoil to the vest;

positioning the scuba diver and hydrofoil underwater at a selected depth;

programming into the controller data effectively defining a maximum depth and a minimum depth;

controlling, by the controller, the overall buoyancy of the user to continuously, automatically, and alternately propel the user to maximum and minimum depths; and generating forward propulsion by orienting the hydrofoil at a negative angle of attack during selected periods when the overall buoyancy of the user and hydrofoil is below neutral buoyancy and orienting the hydrofoil at a positive angle of attack during selected periods when the overall buoyancy of the user and hydrofoil is above neutral buoyancy.

21. An apparatus comprising:

a hydrofoil;

a buoyancy compensator connected to the hydrofoil and comprising a tank containing at least one gas, a vest containing one or more inflatable bladders, and a controller regulating the passage of the at least one gas from the tank into the one or more inflatable bladders and the escape of the at least one gas from the one or more inflatable bladders into the surrounding environment, the controller programmed to adjust a buoyancy force produced by the buoyancy compensator to automatically and alternately propel the buoyancy compensator to a maximum depth and a minimum depth.

22. The apparatus of claim 21, wherein the vest comprises a tank cradle.

23. The apparatus of claim 22, wherein the tank is secured within the tank cradle.

24. The apparatus of claim 23, wherein the hydrofoil secures to the tank.

25. The apparatus of claim 23, wherein the hydrofoil is homogeneously formed with the tank cradle to extend therefrom.

26. The apparatus of claim 23, wherein:

the controller comprises a processor, actuator, pressure sensor, and valve, the processor programmed to cause the actuator to manipulate the valve in accordance with data reported by the pressure sensor to the processor; and the limit is selectable by a user.

* * * * *